US009605502B2

(12) United States Patent
Leuchtenberg et al.

(10) Patent No.: US 9,605,502 B2
(45) Date of Patent: Mar. 28, 2017

(54) METHOD OF HANDLING A GAS INFLUX IN A RISER

(71) Applicant: MANAGED PRESSURE OPERATIONS PTE LTD, Singapore (SG)

(72) Inventors: Christian Leuchtenberg, Singapore (SG); Michael Chandra, Singapore (SG); Carlos Goncalves, Udon Thani (TH)

(73) Assignee: MANAGED PRESSURE OPERATIONS PTE LTD, Singapore (SG)

( * ) Notice: Subject to any disclaimer, the term of this patent is extended or adjusted under 35 U.S.C. 154(b) by 0 days.

(21) Appl. No.: 14/394,038

(22) PCT Filed: Apr. 10, 2013

(86) PCT No.: PCT/EP2013/057524
§ 371 (c)(1),
(2) Date: Oct. 10, 2014

(87) PCT Pub. No.: WO2013/153135
PCT Pub. Date: Oct. 17, 2013

(65) Prior Publication Data

US 2015/0068758 A1 Mar. 12, 2015

(30) Foreign Application Priority Data

Apr. 11, 2012 (GB) ..... 1206405.1

(51) Int. Cl.
*E21B 19/09* (2006.01)
*E21B 17/07* (2006.01)
(Continued)

(52) U.S. Cl.
CPC ..... *E21B 33/038* (2013.01); *E21B 17/01* (2013.01); *E21B 21/001* (2013.01); *E21B 21/08* (2013.01);
(Continued)

(58) Field of Classification Search
None
See application file for complete search history.

(56) References Cited

U.S. PATENT DOCUMENTS 2,609,836 A 9/1952 Knox
2,731,281 A 1/1956 Knox
(Continued)

FOREIGN PATENT DOCUMENTS

EP 1 659 260 A2 5/2006
EP 2378056 A2 10/2011
(Continued)

OTHER PUBLICATIONS

U.S. Appl. No. 14/384,619, filed Sep. 11, 2014.

*Primary Examiner* — Matthew R Buck
*Assistant Examiner* — Douglas S Wood
(74) *Attorney, Agent, or Firm* — Norman B. Thot

(57) ABSTRACT

A method of operating a system for handling an influx of gas into a marine riser during the drilling of a well bore includes the steps of operating a first riser closure apparatus to close the riser at a first point above a flow spool provided in the riser, there being a riser gas handling line extending from the riser at the flow spool to a riser gas handling manifold, operating a second riser closure apparatus to close the riser at a second point below the flow spool, pumping fluid into an inlet line which extends into the riser at a point above the second point but below the flow spool, and operating a
(Continued)

Figure 1:
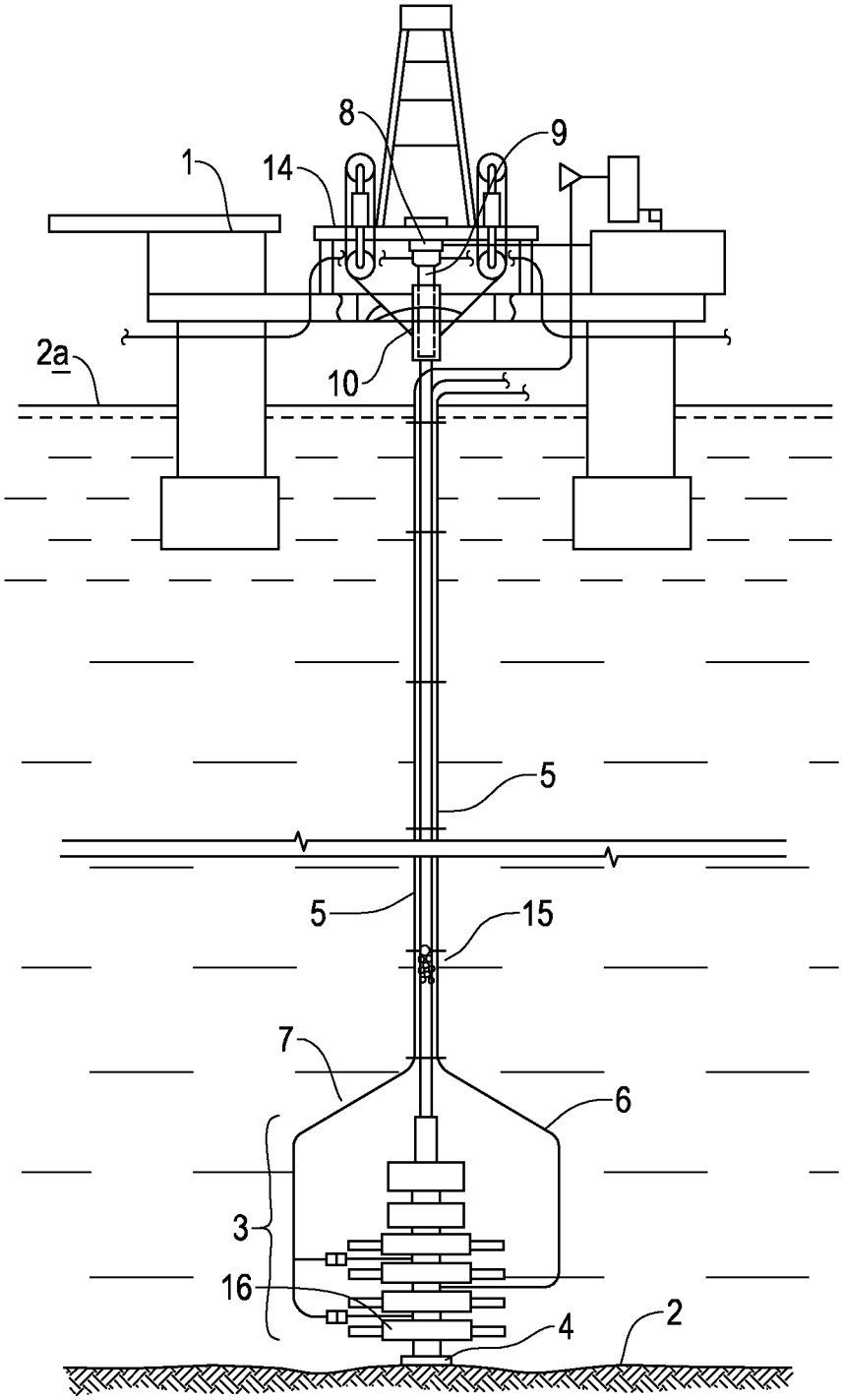
FIG. 1 PRIOR ART

choke provided in the riser gas handling manifold to maintain the pressure in the inlet line or the riser at a substantially constant pressure.

28 Claims, 16 Drawing Sheets

(51) Int. Cl.

| | |
|---|---|
| ***E21B 17/01*** | (2006.01) |
| ***E21B 7/00*** | (2006.01) |
| ***E21B 21/08*** | (2006.01) |
| ***E21B 44/00*** | (2006.01) |
| ***E21B 33/038*** | (2006.01) |
| ***E21B 21/00*** | (2006.01) |
| ***E21B 34/04*** | (2006.01) |
| ***E21B 47/06*** | (2012.01) |

(52) U.S. Cl.
CPC ..... *E21B 34/045* (2013.01); *E21B 44/00* (2013.01); *E21B 47/06* (2013.01)

(56) References Cited

U.S. PATENT DOCUMENTS

| | | | | |
|---|---|---|---|---|
| 3,044,481 | A | 7/1962 | Regan | |
| 3,128,077 | A | 4/1964 | Lucky | |
| 3,225,831 | A | 12/1965 | Knox | |
| 3,299,957 | A | 1/1967 | O'Neill et al. | |
| 3,323,773 | A | 6/1967 | Walker | |
| 3,561,723 | A | 2/1971 | Cugini | |
| 3,651,823 | A | 3/1972 | Milsted, Sr. | |
| 3,667,721 | A | 6/1972 | Vujasinovic | |
| 3,695,349 | A | 10/1972 | Murman et al. | |
| 3,942,824 | A | 3/1976 | Sable | |
| 4,046,191 | A | 9/1977 | Neath | |
| 4,095,421 | A | 6/1978 | Silcox | |
| 4,097,253 | A * | 6/1978 | Phillips | B01D 19/0047 96/168 |
| 4,098,341 | A | 7/1978 | Lewis | |
| 4,317,557 | A | 3/1982 | Orr | |
| 4,484,785 | A | 11/1984 | Jackson | |
| 4,509,405 | A | 4/1985 | Bates | |
| 4,614,148 | A | 9/1986 | Bates | |
| 4,615,543 | A | 10/1986 | Cannon | |
| 4,626,135 | A | 12/1986 | Roche | |
| 4,832,126 | A | 5/1989 | Roche | |
| 4,844,179 | A | 7/1989 | Forrest et al. | |
| 4,858,882 | A | 8/1989 | Beard et al. | |
| 4,923,008 | A | 5/1990 | Wachowicz et al. | |
| 5,803,193 | A | 9/1998 | Krueger et al. | |
| 6,192,680 | B1 | 2/2001 | Brugman et al. | |
| 6,349,779 | B1 | 2/2002 | Gilbert | |
| 6,474,422 | B2 | 11/2002 | Schubert et al. | |
| 6,655,405 | B2 | 12/2003 | Hollister et al. | |
| 6,913,092 | B2 | 7/2005 | Bourgoyne et al. | |
| 7,357,145 | B2 | 4/2008 | Soderberg | |
| 7,575,073 | B2 * | 8/2009 | Swartout | E21B 21/065 175/209 |
| 7,997,345 | B2 | 8/2011 | Hannegan | |
| 8,347,982 | B2 * | 1/2013 | Hannegan | E21B 19/09 166/347 |
| 8,776,894 | B2 * | 7/2014 | Orbell | E21B 17/085 166/345 |
| 8,978,774 | B2 * | 3/2015 | Fossli | E21B 21/001 166/347 |
| 9,109,420 | B2 * | 8/2015 | Tindle | E21B 33/035 |
| 2002/0066569 | A1 | 6/2002 | Schubert et al. | |
| 2002/0066597 | A1 | 6/2002 | Schubert et al. | |
| 2002/0100589 | A1 | 8/2002 | Childers et al. | |
| 2003/0136587 | A1 | 7/2003 | Boulet | |
| 2004/0195009 | A1 | 10/2004 | Boulet | |
| 2008/0185046 | A1 | 8/2008 | Springett et al. | |
| 2008/0267786 | A1 | 10/2008 | Springett et al. | |
| 2010/0326738 | A1 | 12/2010 | Boulet | |
| 2011/0005770 | A1 | 1/2011 | Scranton et al. | |
| 2011/0088913 | A1 | 4/2011 | Baugh | |
| 2011/0100637 | A1 | 5/2011 | Gustafson | |
| 2011/0131964 | A1 | 6/2011 | Kocurek et al. | |
| 2011/0284236 | A1 | 11/2011 | Baugh | |
| 2012/0111572 | A1 | 5/2012 | Cargol, Jr. | |
| 2012/0227978 | A1 * | 9/2012 | Fossli | E21B 21/001 166/363 |
| 2013/0233562 | A1 | 9/2013 | Leuchtenberg | |

FOREIGN PATENT DOCUMENTS

| | | | |
|---|---|---|---|
| FR | 2789438 | A1 | 8/2000 |
| FR | 2835014 | A1 | 7/2003 |
| FR | 2851608 | A1 | 8/2004 |
| FR | 2927937 | A1 | 8/2009 |
| GB | 326615 | A | 3/1930 |
| GB | 471732 | A | 9/1937 |
| GB | 471794 | A | 9/1937 |
| GB | 474499 | A | 11/1937 |
| GB | 627196 | A | 8/1949 |
| GB | 1248499 | A | 10/1971 |
| GB | 1 294 288 | A | 10/1972 |
| GB | 2489265 | A | 9/2012 |
| GB | 2500188 | A | 9/2013 |
| RU | 2 198 282 | C2 | 5/2002 |
| WO | WO 02/088516 | A1 | 11/2002 |
| WO | WO 03/023181 | A1 | 3/2003 |
| WO | WO 2005/093204 | A1 | 10/2005 |
| WO | WO 2009/123476 | A1 | 10/2009 |
| WO | WO 2009/132300 | A2 | 10/2009 |
| WO | WO 2011/058031 | A2 | 5/2011 |
| WO | WO 2011/128690 | A1 | 10/2011 |
| WO | WO 2011/149806 | A2 | 12/2011 |
| WO | WO 2012/127180 | A2 | 9/2012 |
| WO | WO 2012/127227 | A2 | 9/2012 |

* cited by examiner

METHOD OF HANDLING A GAS INFLUX IN A RISER

DESCRIPTION OF INVENTION

This invention relates to a method for handling a gas influx in a riser during deep water drilling operations, particularly to a method of circulating gas, which has risen undetected above one or more subsea blow out preventers, safely out of the riser.

A major hazard in deep water drilling operations is the uncontrolled release of gas from the fluid system that can occur when gas has been circulated above the blow out preventers (BOPs) undetected. Once the entrained gas reaches the bubble point of the fluid system being used, the gas is released and expands quickly. The rapid release can unload large volumes of fluid to the rig floor followed by the release of hydrocarbon gas. This may set off a chain reaction which results in a further uncontrolled and dramatic release of gas and drilling fluid at the rig floor, and as the rapid unloading of drilling fluid reduces the applied bottom hole pressure (BHP), the event can also result in a secondary influx of formation fluids into the wellbore.

Although not a common event, at present this is dealt with by closing a diverter just below the rig floor, to allow the released gas to be vented overboard.

Although this diverts the released gas away from personnel, it does not control the release or manage the bottom hole pressure during the event. Moreover, due to the speed at which the gas is released, the reaction time using the current system technology has been shown to be too slow to fully protect the drill crew. The probability of occurrence increases with the setting depth of the subsea BOP.

FIG. 1 is a schematic of a typical, prior art, offshore drilling rig. A floating drilling vessel 1, having a rig floor 14, is provided for drilling a borehole through a seabed 2 beneath water surface 2*a*. A drill string (not shown) extends from the drilling vessel 1 to the borehole via a blowout preventer (BOP) stack 3 which is disposed on the seafloor 2 above a wellhead 4. A riser 5 extends up from the BOP stack 3 around the drill string, and is provided with a slip joint 10. Choke 6 and kill lines 7 are provided between the floating vessel 1 and blowout preventer stack 3, for use well control. A diverter 8 is connected to the inner barrel 9 of the slip joint 10.

Figure 2:
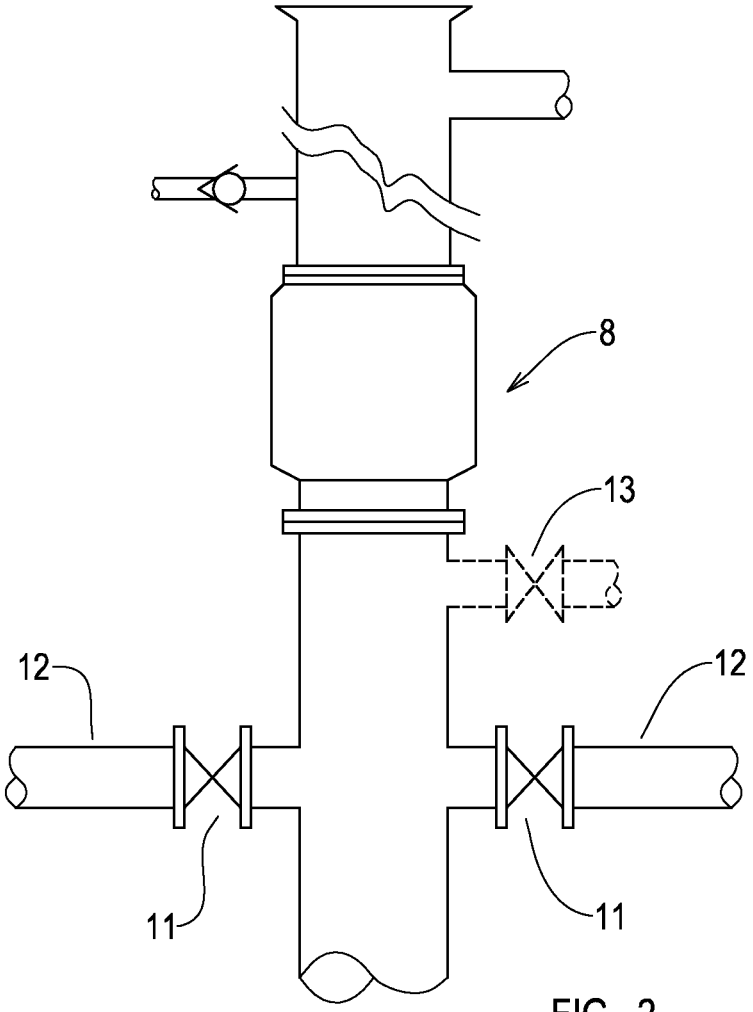
FIG. 2 PRIOR ART

A prior art diverter 8 is illustrated in FIG. 2, and is an annular sealing device used to close and pack-off the annulus around the drilling string or, if no drill string is present to close the riser 5 completely. The diverter 8 is provided with diverter lines 12 which provide a conduit for the controlled release of fluid from the riser or riser annulus. As such, the diverter 8 provides a means of removing gas in the riser by routing the contents overboard in a direction where the wind will not carry the diverted fluids back to the drilling rig.

Diverters 8 are typically used in low pressure systems (200-500 psi working pressure), and so are not configured to retain high pressures. As such, in prior art systems, the diverter control system is operated such that the diverter will not be operated to shut-in the well. Hydraulic or pneumatic valves 11 are provided in the diverter lines 12, these valves being operable by an automatically sequenced diverter system to open or close the diverter lines. The diverter system is configured to ensure that the diverter line valves 11 are open before the diverter 8 is closed.

The diverter illustrated in FIG. 2, has two vent lines 12, and a flow line 13. As stipulated in API RP 64, SE November 2007, this diverter closing system should be capable of opening the vent line 12 and flow line valves 13 and closing the annular packing element on the pipe within 30 sec of actuation for 20" ID packing element or less and 45 secs for packing element ID greater than 20". In general, however, well conditions required faster closing times that recommended by API RP 64, especially with the use of oil based mud or synthetic base mud since once the gas is undetected upon entry to the well bore, it goes into solution and there will be no observable sign until it comes out of solution very close to surface. This normally leaves the operator will very little time to secure the well and if no action is taken, there will be a violent unloading of gas in the marine riser endangering personnel on the rig floor 14.

When an influx (particularly swab influx) is taken while drilling with a marine riser there is a possibility that the gas will have migrated or been circulated above the subsea BOP stack 3 before the well is shut-in. When this happens the riser 5 provides a direct conduit for uncontrolled fluid flow to reach the drilling rig. If evacuated, the resulting low pressure in the riser annulus renders the differential pressure across the riser so great that the riser, in particularly the lower joints could suffer from hydrostatic collapse when the collapse strength of the riser pipe is exceeded. To combat this, some deep water risers have been fitted with riser fill up valves which are intended to be used to open the riser annulus to sea water once the hydrostatic pressure in the riser has dropped and before hydrostatic collapse occurs. Typically, such valves are set to open when the hydrostatic pressure of mud in the riser falls below the hydrostatic pressure of the seawater by a certain set differential. A manual override is usually provided. There is, however, a very low utilization of riser fill up valves as they have not been industry proven to be reliable due to the unsophisticated means of control which is highly dependent on the density of the seawater. Moreover, if the rapid unloading of drilling fluid in the riser reduces the applied bottom hole pressure resulting in a secondary kick, formation fluids entering the wellbore will provide sufficient kinetic energy for uncontrolled release of seawater all over the drilling vessel 1.

Figure 3:
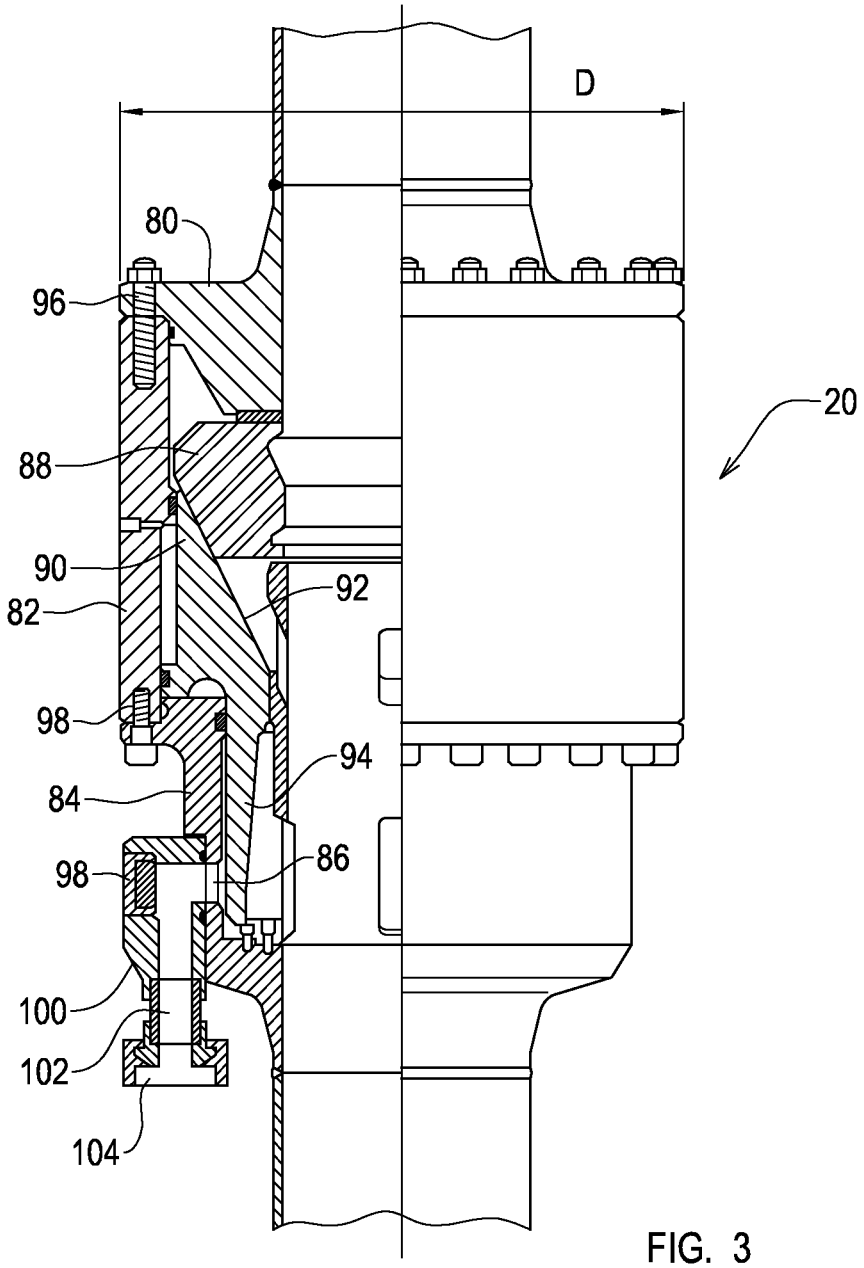
FIG. 3 PRIOR ART
Figure 4:
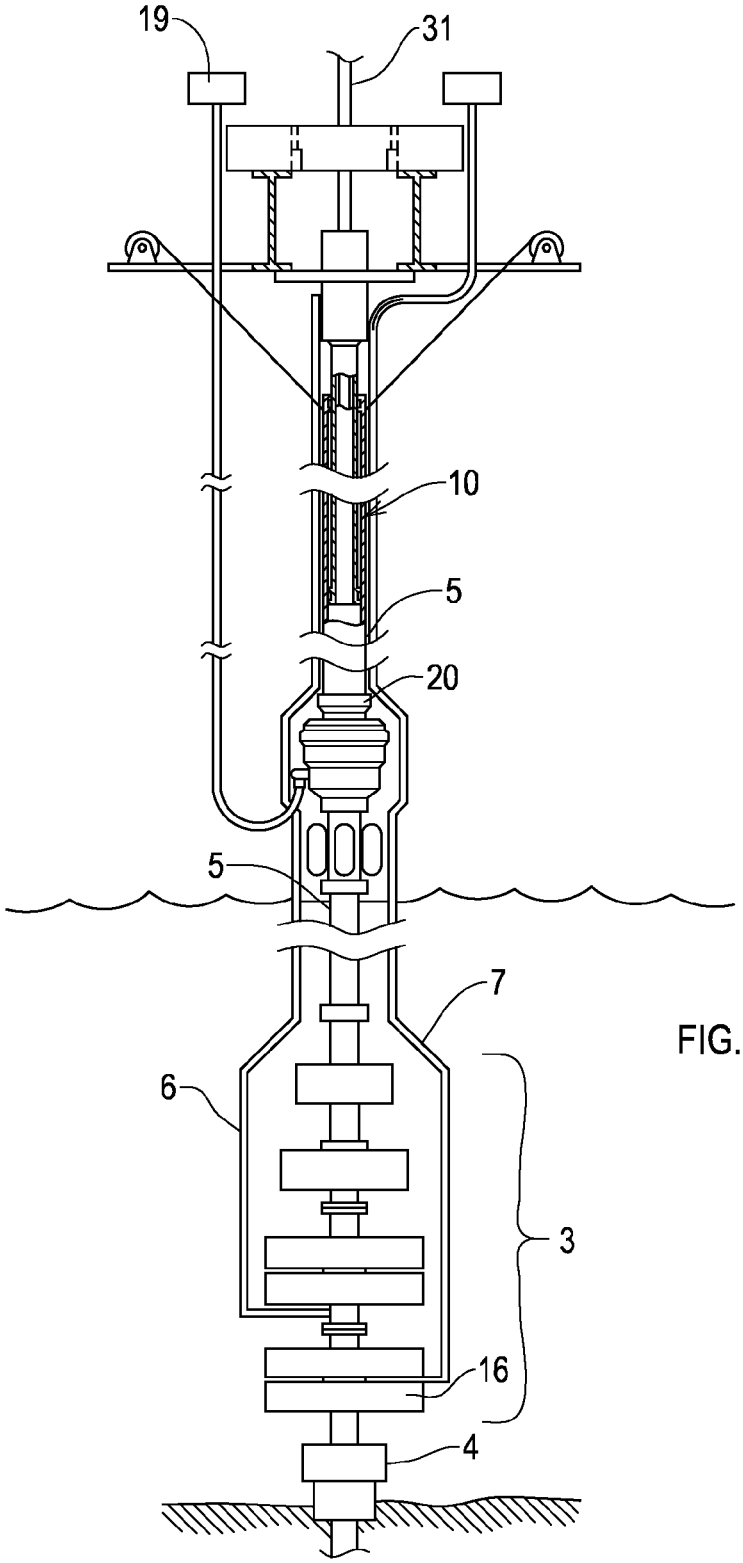
FIG. 4 PRIOR ART

An alternative configuration of riser control device is shown in U.S. Pat. No. 4,626,135. This riser control device is illustrated in detail in FIG. 3, and in position in an offshore drilling installation in FIG. 4. The riser control device is derived from annular blowout preventer technology, and is an improved diverter adapted for riser pressure control installed just below the slip joint 10. FIG. 3 illustrates the construction details of the riser control device 20. The riser control device 20 includes a cylindrical housing or outer body 82 with a lower body 84 and an upper head 80 connected to the outer body 82 by means of bolts 97 and 96. Located within the housing 82 are an annular packing unit 88 and a piston 90 which is shaped so as to urge the annular packing unit 88 radially inwardly upon the upward movement of piston 90. The lower wall 94 of piston 90 covers an outlet passage 86 in the lower body 84 when the piston is in the lower (open) position. When the piston 90 moves upwardly to force the packing element 88 inwardly about a drill pipe extending through the bore of the riser control device 20, the lower end of the piston 94 moves upwardly and opens the outlet passage 86 which is connected to the rig's auxiliary choke line, as illustrated in FIG. 4.

When an influx is suspected above the riser 5, the riser control device 20 is closed, the auxiliary choke line 16 is opened and then the bottom most subsea ram blowout preventer 16 is closed. Mud is applied via the kill line 7 to the annulus of the stack above the ram blowout preventer 16.

The kill mud is then pumped into the annulus between the interior of the riser string 5 and the exterior of the drill pipe 31. The drilling mud provides return flow circulation through the drilling rig's choke manifold 19 until a normal well pressure is restored.

It is an object of the present invention to provide an improved means of controlling gas expansion in a marine riser, and hence, and improved method and apparatus for regaining hydrostatic control of a riser after an influx of gas into the riser.

According to a first aspect of the invention, we provide a method of operating a system for handling an influx of gas into a marine riser during the drilling of a well bore, the method including the steps of operating a first riser closure apparatus to close the riser at a first point above a flow spool provided in the riser, there being a riser gas handling line extending from the riser at the flow spool to a riser gas handling manifold, operating a second riser closure apparatus to close the riser at a second point below the flow spool, pumping fluid into an inlet line which extends into the riser at a point above the second point but below the flow spool, wherein the method further comprises operating a choke provided in the riser gas handling manifold to maintain the pressure in the inlet line or the riser between the first and second points at a substantially constant pressure.

By flow spool, we mean a portion of the riser which provides at least one side port by means of which fluid may be diverted out of the riser.

The first riser closure apparatus may be an annular blow out preventer.

The step of operating the first riser closure apparatus may comprise operating the first riser closure apparatus so that it seals around a drill string extending down the riser.

The second riser closure apparatus may be a blow out preventer in a subsea blowout preventer stack.

The step of operating the second riser closure apparatus may comprise operating the second riser closure device so that it seals around a drill string extending down the riser.

In one embodiment of the invention, the first point is below a slip joint provided in the riser.

In one embodiment of the invention the second point is just above a well head.

The riser gas handling manifold may be located on a deck floor of a drilling rig from which the riser is suspended.

In one embodiment of the invention, the inlet line comprises a booster line which extends from a pump located on a drilling rig from which the riser is suspended, to a portion of the riser just above the uppermost blowout preventer in a subsea blowout preventer stack at the lowermost end of the riser.

The method may further include the step of opening a riser gas handling line isolation valve which is operable to permit or substantially prevent flow of fluid along the riser gas handling line after operating the first riser closure apparatus.

The step of opening the riser gas handling line isolation valve may be carried out before operating the second riser closure apparatus.

The method may further include the step of ceasing the pumping of fluid into the riser prior to the step of operating the second riser closure apparatus.

In one embodiment of the invention, the step of ceasing the pumping of fluid into the riser is carried out after the step of operating the first riser closure apparatus.

The rate of pumping of fluid into the riser via the inlet line may be increased to a predetermined level, and, at the same time, the choke operated to maintain a substantially constant pressure in the riser.

In this case, the step of operating the choke to maintain a substantially constant pressure in the inlet line may be commenced once the rate of pumping of fluid into the riser via the inlet line has reached the predetermined value.

In one embodiment of the invention there is a second riser gas handling line extending from the riser at the flow spool to the riser gas handling manifold.

In this case, the method may further include the step of opening a second riser gas handling line isolation valve which is operable to permit or substantially prevent flow of fluid along the second riser gas handling line after operating the first riser closure apparatus.

The step of operating the choke provided in the riser gas handling manifold to maintain the pressure in the inlet line at a substantially constant pressure, may comprise using a pressure sensor to measure the fluid pressure in the inlet line, and transmitting a inlet pressure signal representative of the fluid pressure in the inlet line to a controller, the controller being programmed to operate the choke in accordance with the inlet pressure signal.

The method may further include the steps of monitoring the rate of pumping of fluid into the inlet line, and, if this rate of pumping deviates from a predetermined value or range of values, using a pressure sensor to measure the fluid pressure in the riser, and operating the choke to maintain the pressure in the riser at a substantially constant pressure, rather than the pressure in the inlet line. In this case, the method may further include of the steps of returning to operating the choke to maintain the pressure in the inlet line at a substantially constant pressure if the pumping rate returns to the predetermined value or range of values.

The method may further include the step of directing fluid discharged from the riser gas handling manifold to a mud gas separator located on the floor of a drilling rig from which the riser is suspended.

In this case, the fluid discharged from the riser gas handling manifold may be directed to a diverter before being directed to the mud gas separator, the diverter acting to separate a proportion of entrained gas from the remainder of the fluid.

All the fluid from the diverter may be directed to the mud gas separator.

The mud gas separator may be provided with baffle plates in its lowermost end.

The method may further comprise the step of directed the denser fluids from the mud gas separator to a solids processing apparatus.

The method may further comprises the step of directing the lighter fluid from the mud gas separator to a vent line which exhausts to atmosphere.

The mud gas separator may be provided with a drain at its lowermost end, the drain having a liquid seal to retain pressure in the mud gas separator.

The method may further comprise pumping extra fluid into the mud gas separator, in addition to the fluid entering from the riser gas handling manifold.

Figure 5:
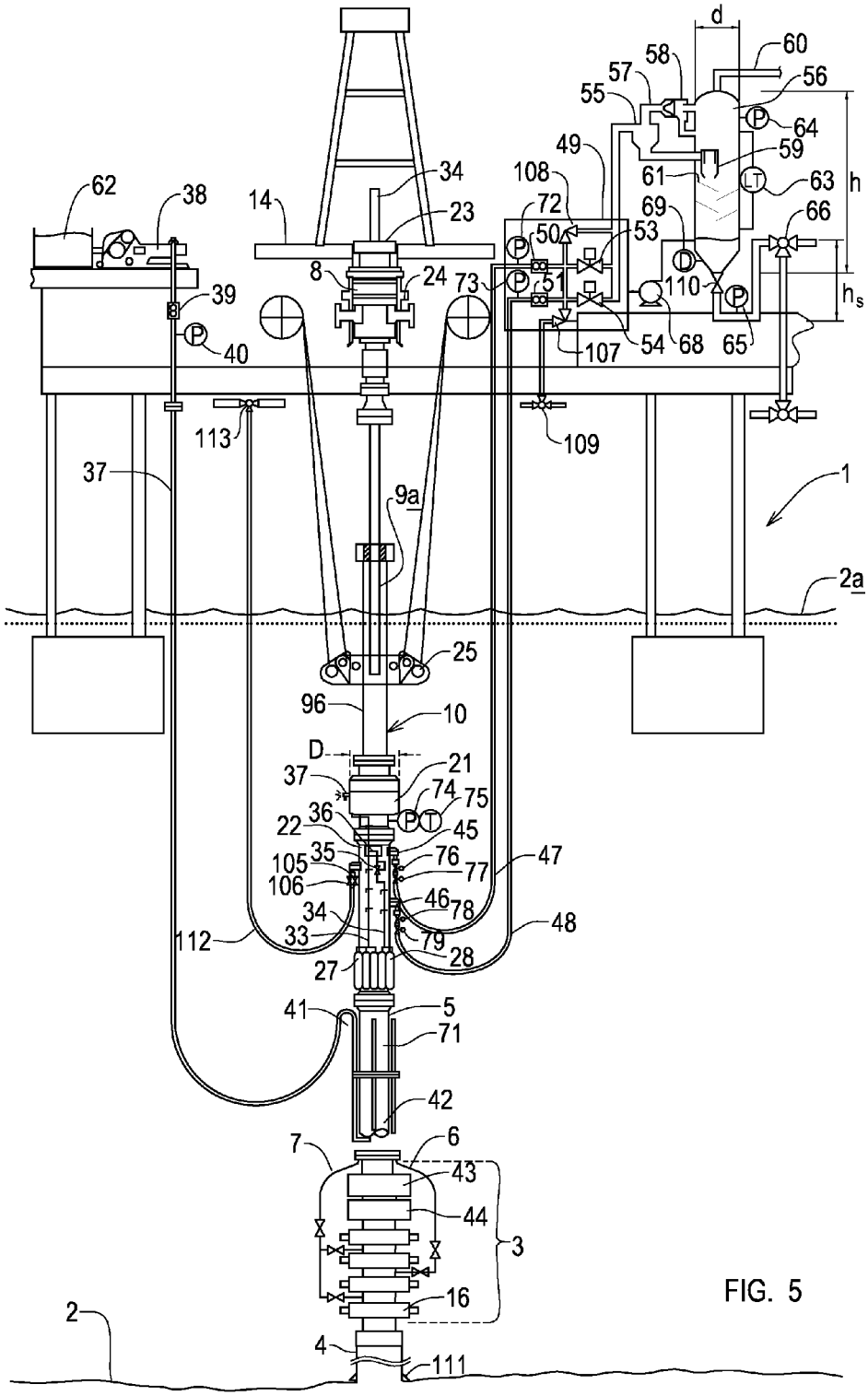
Figure 6:
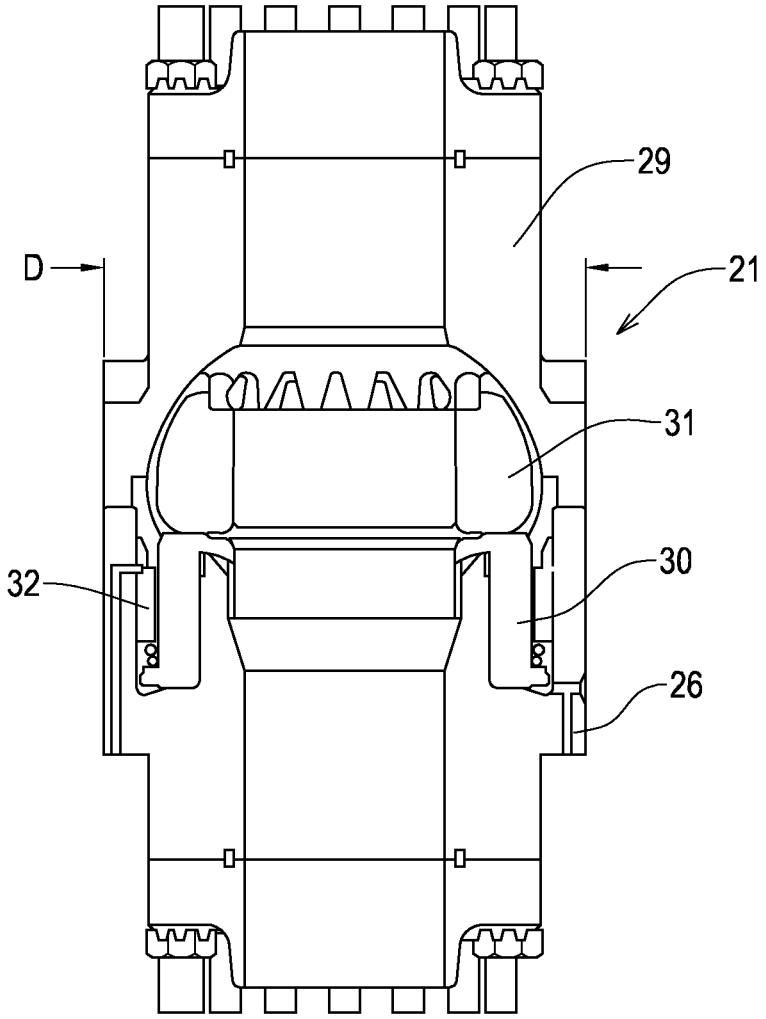
Figure 7:
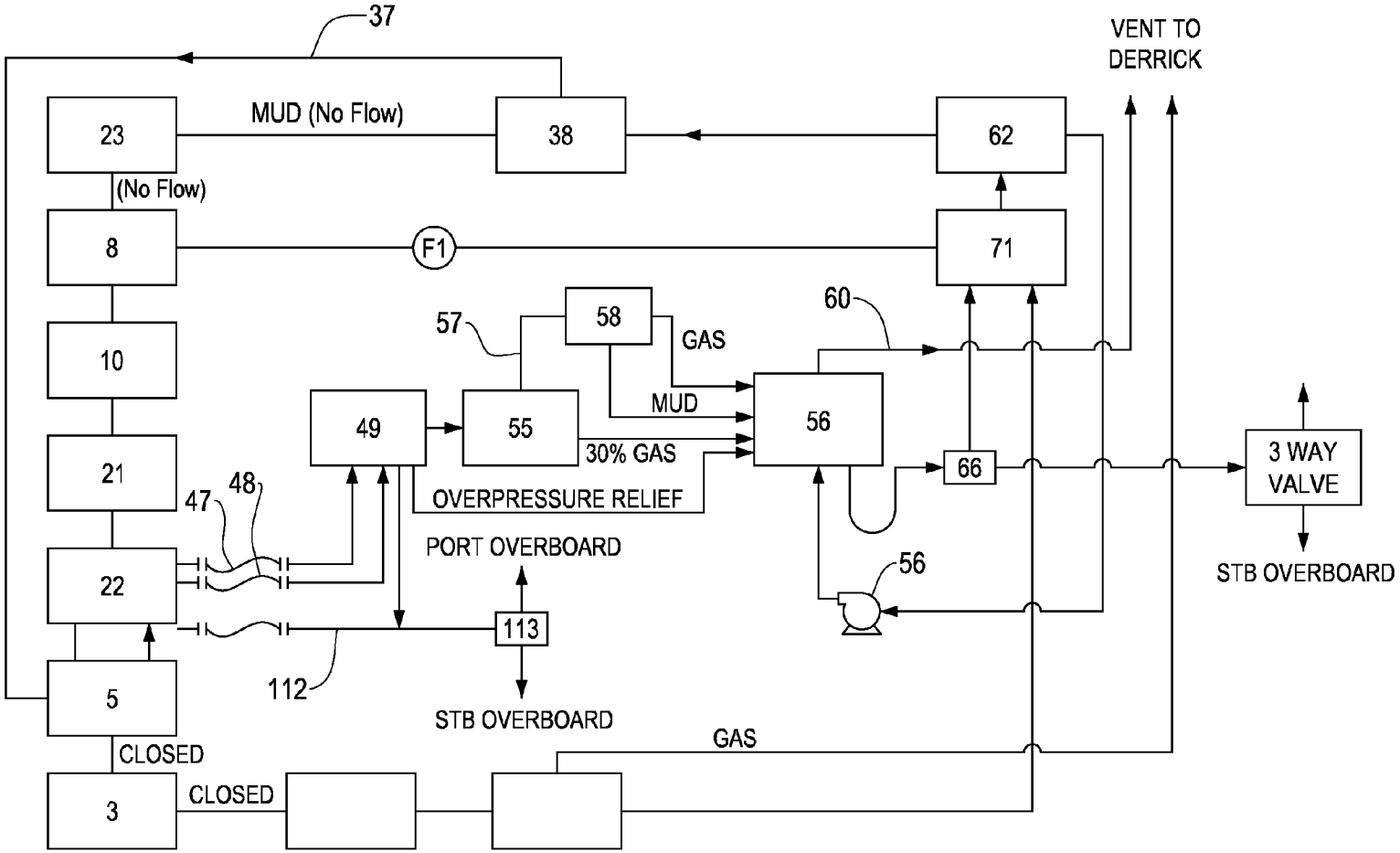
Figure 8:
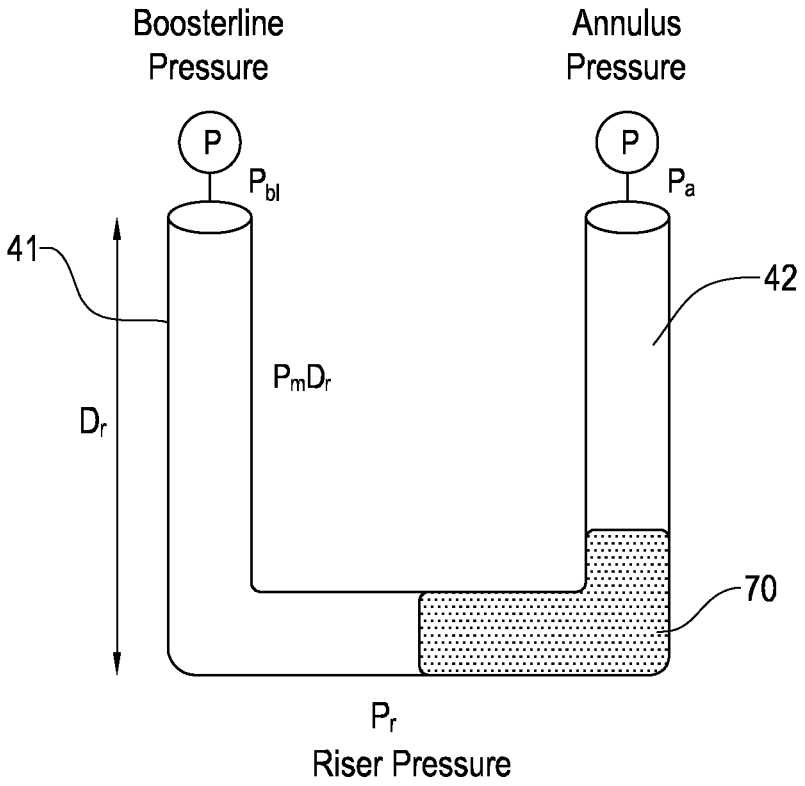
Figure 9A:
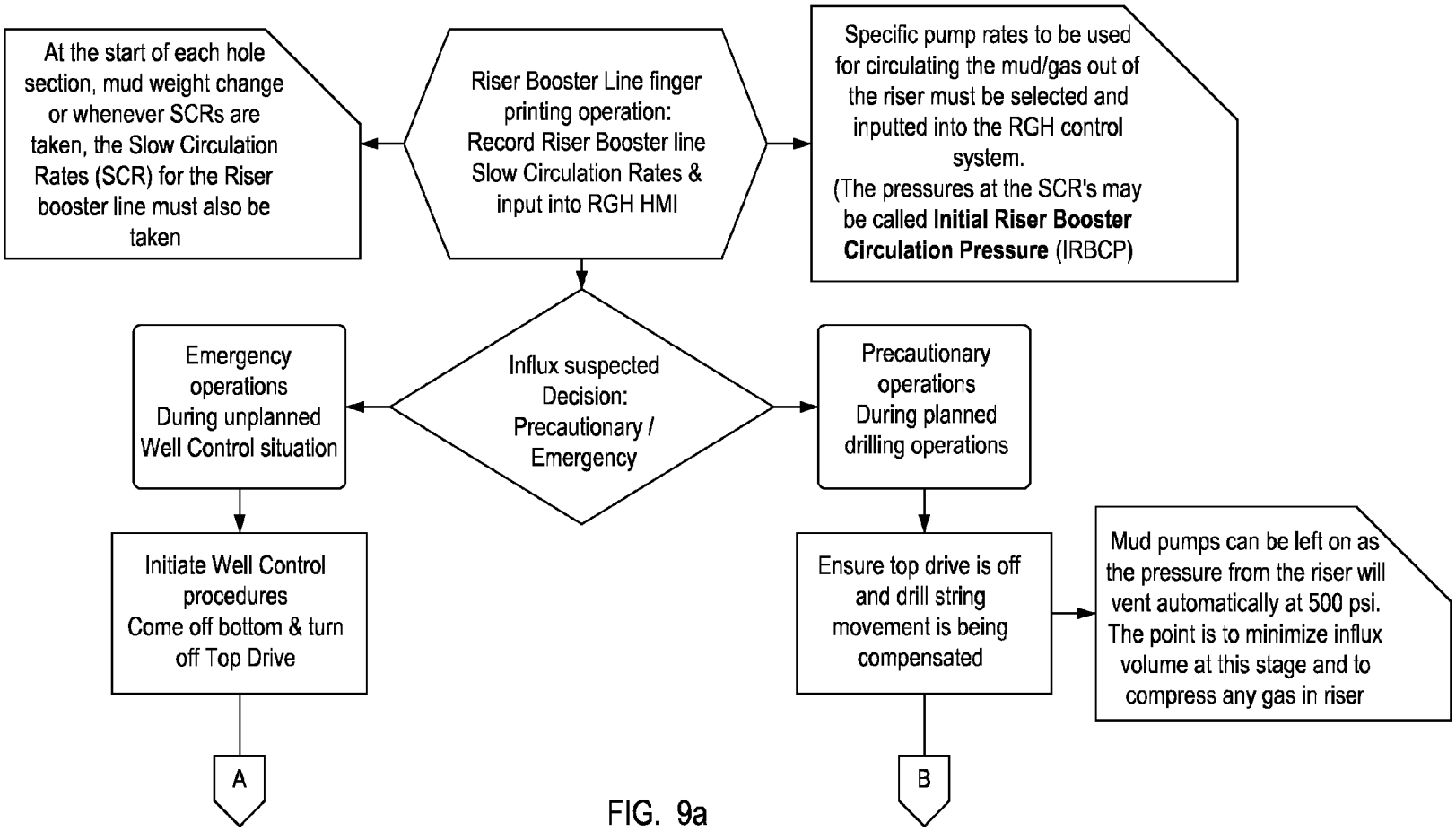
Figure 9B:
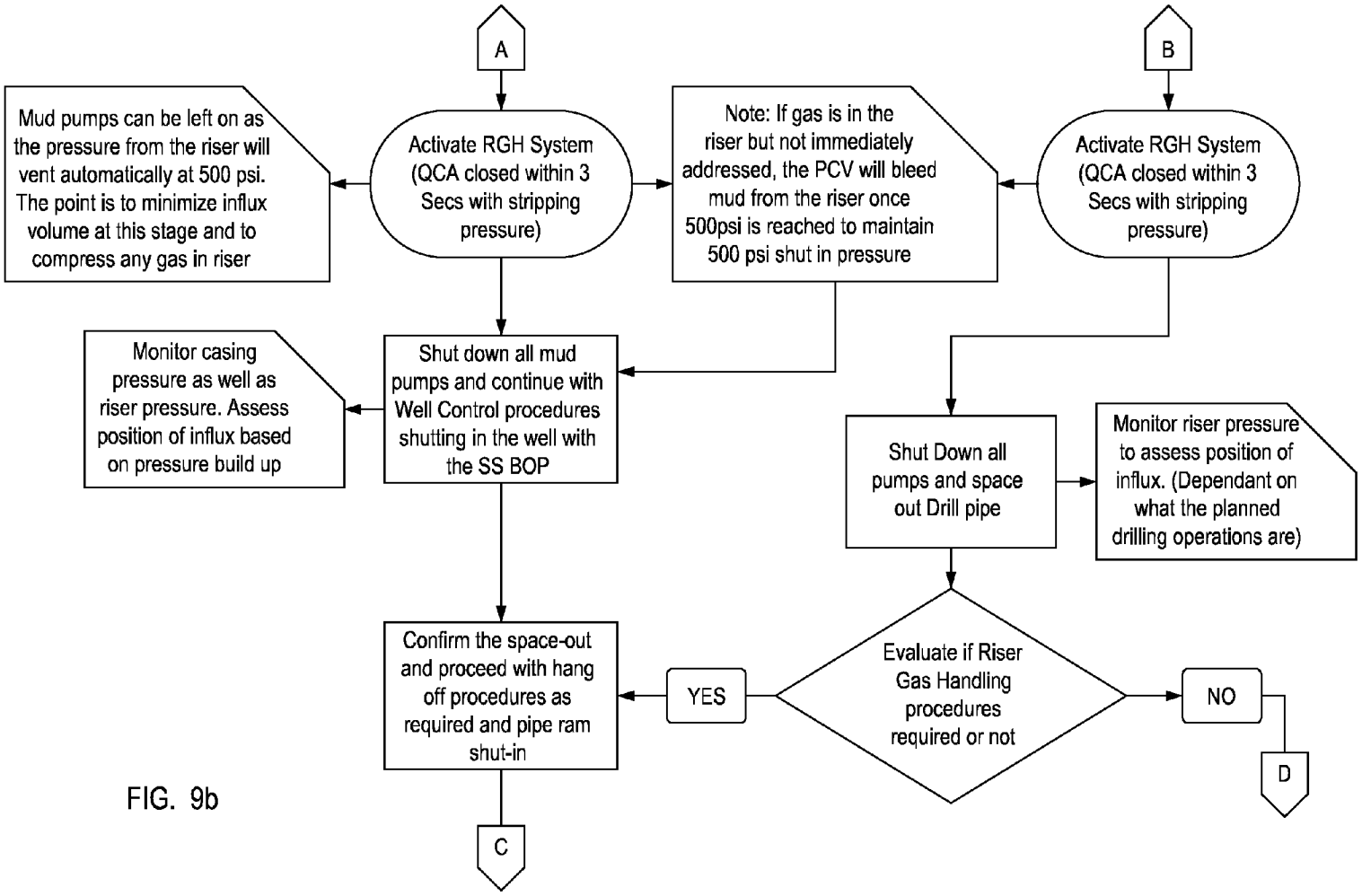
Figure 9C:
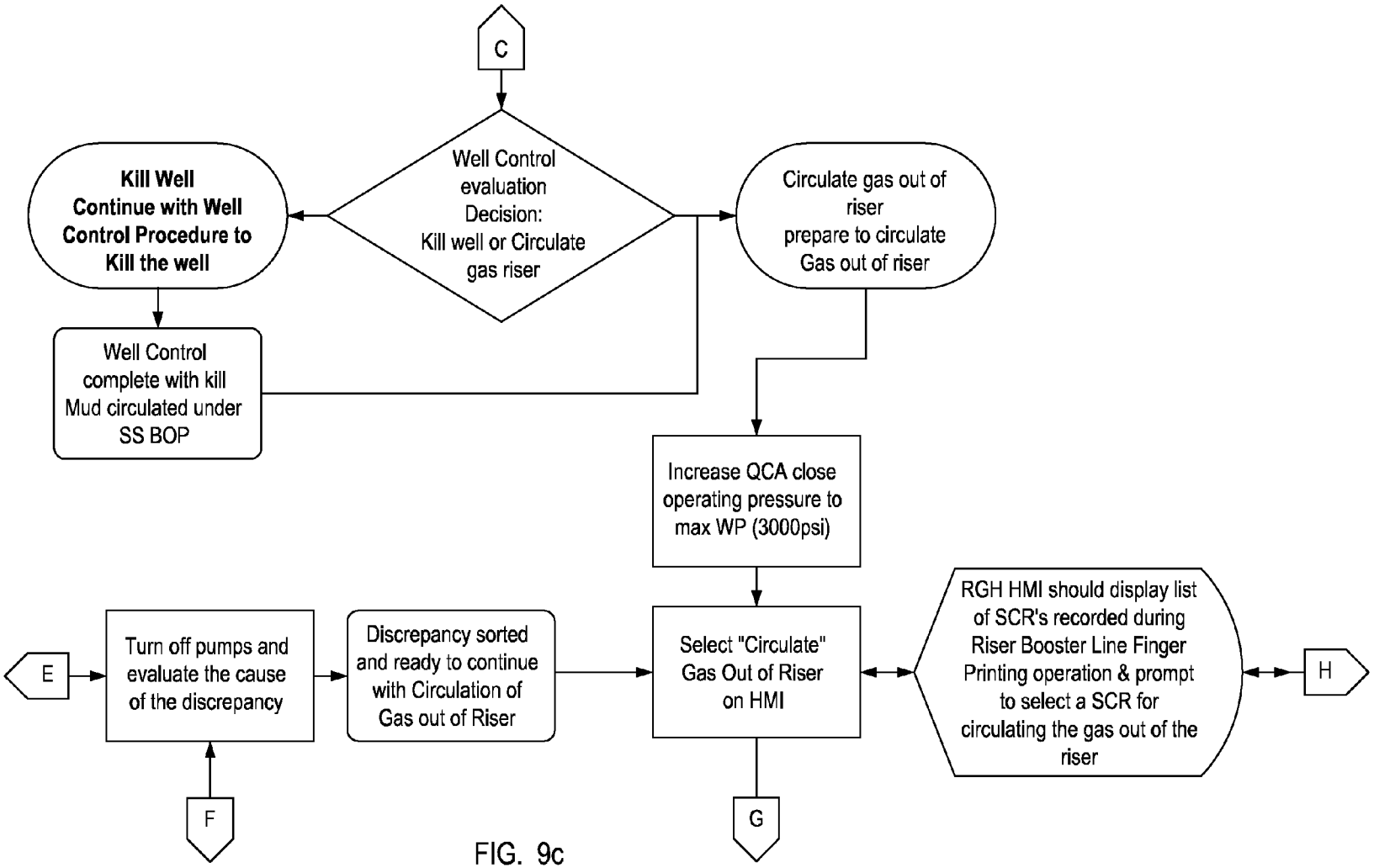
Figure 9D:
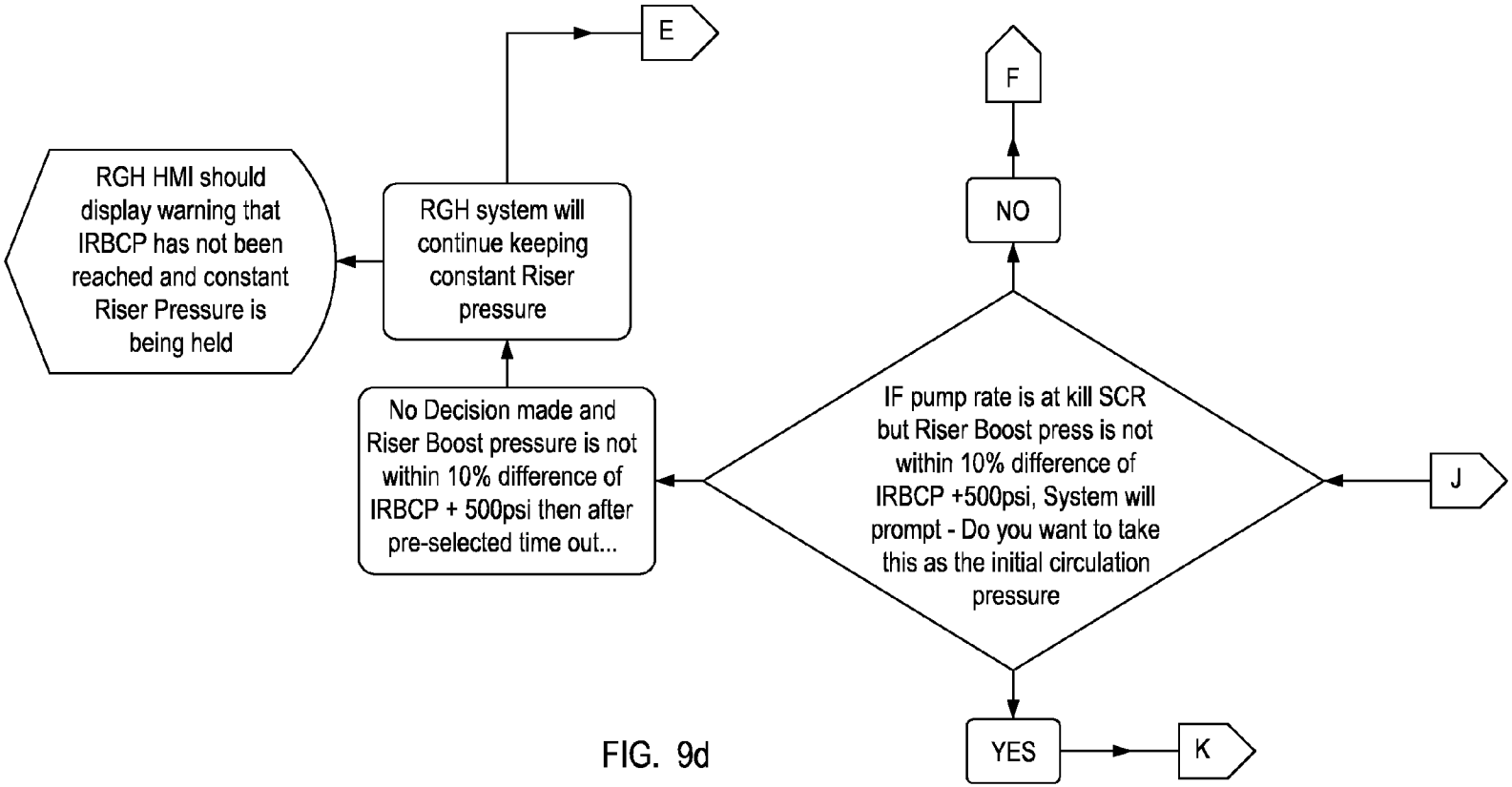
Figure 9E:
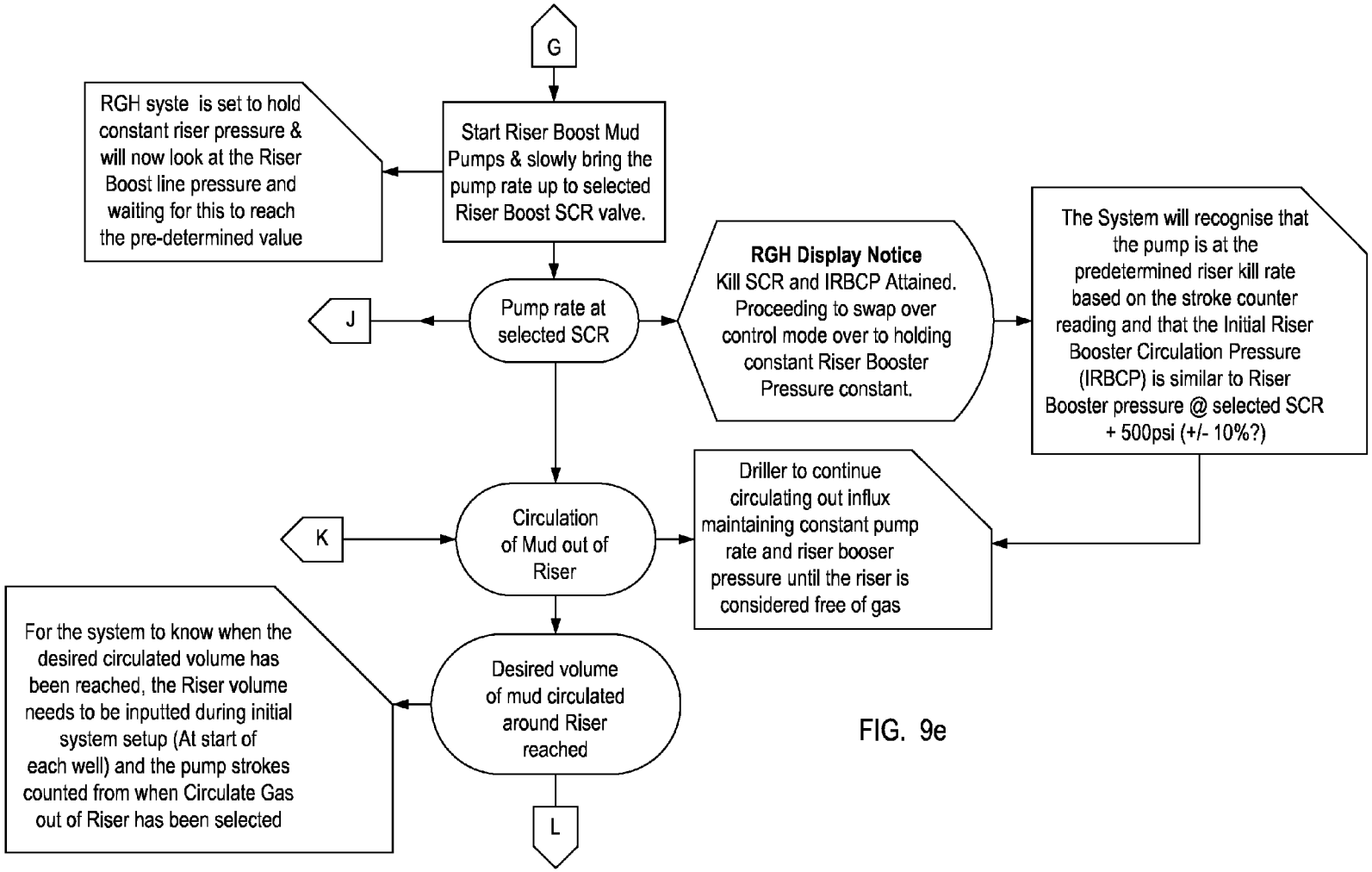
Figure 9F:
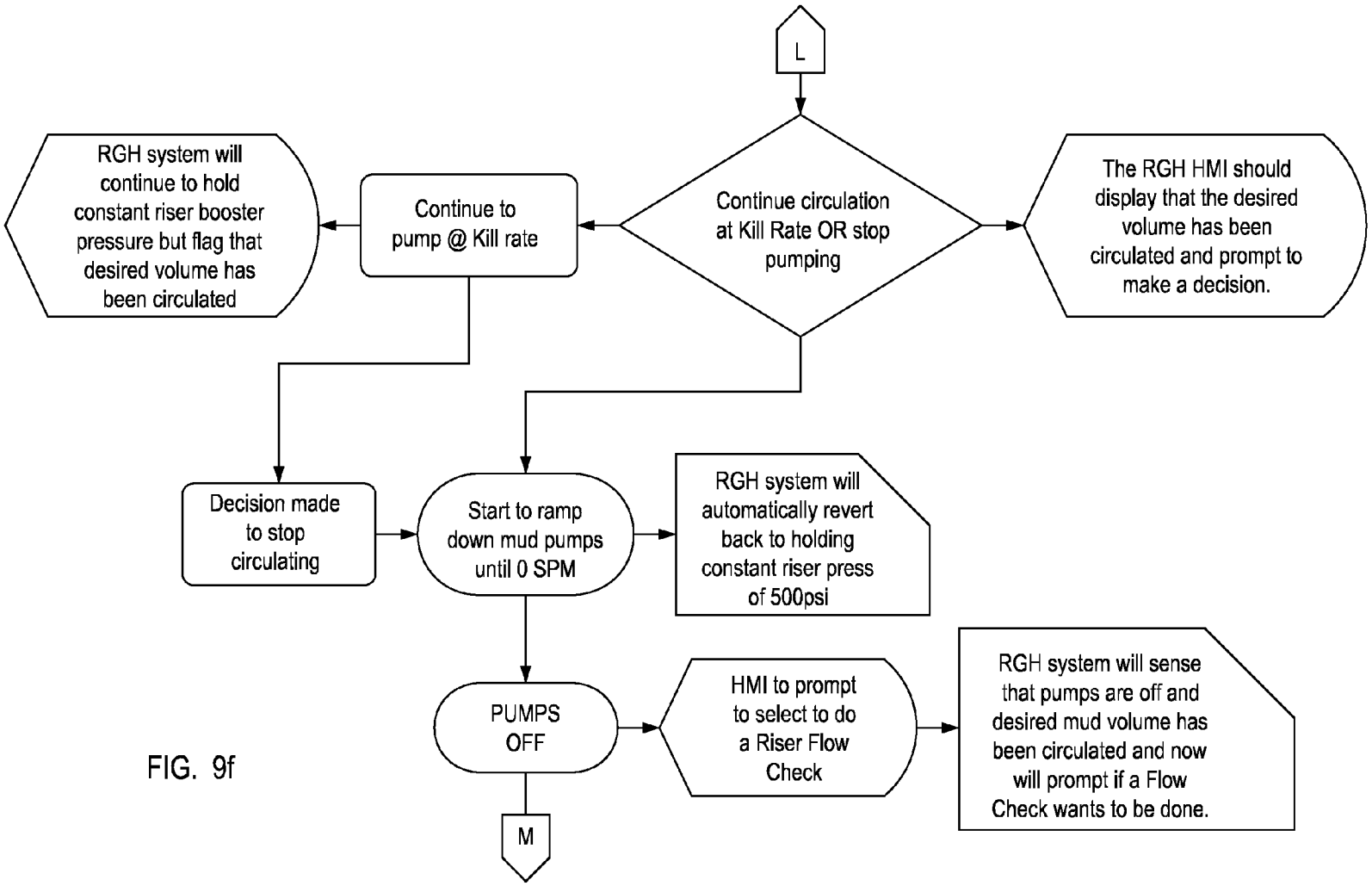
Figure 9G:
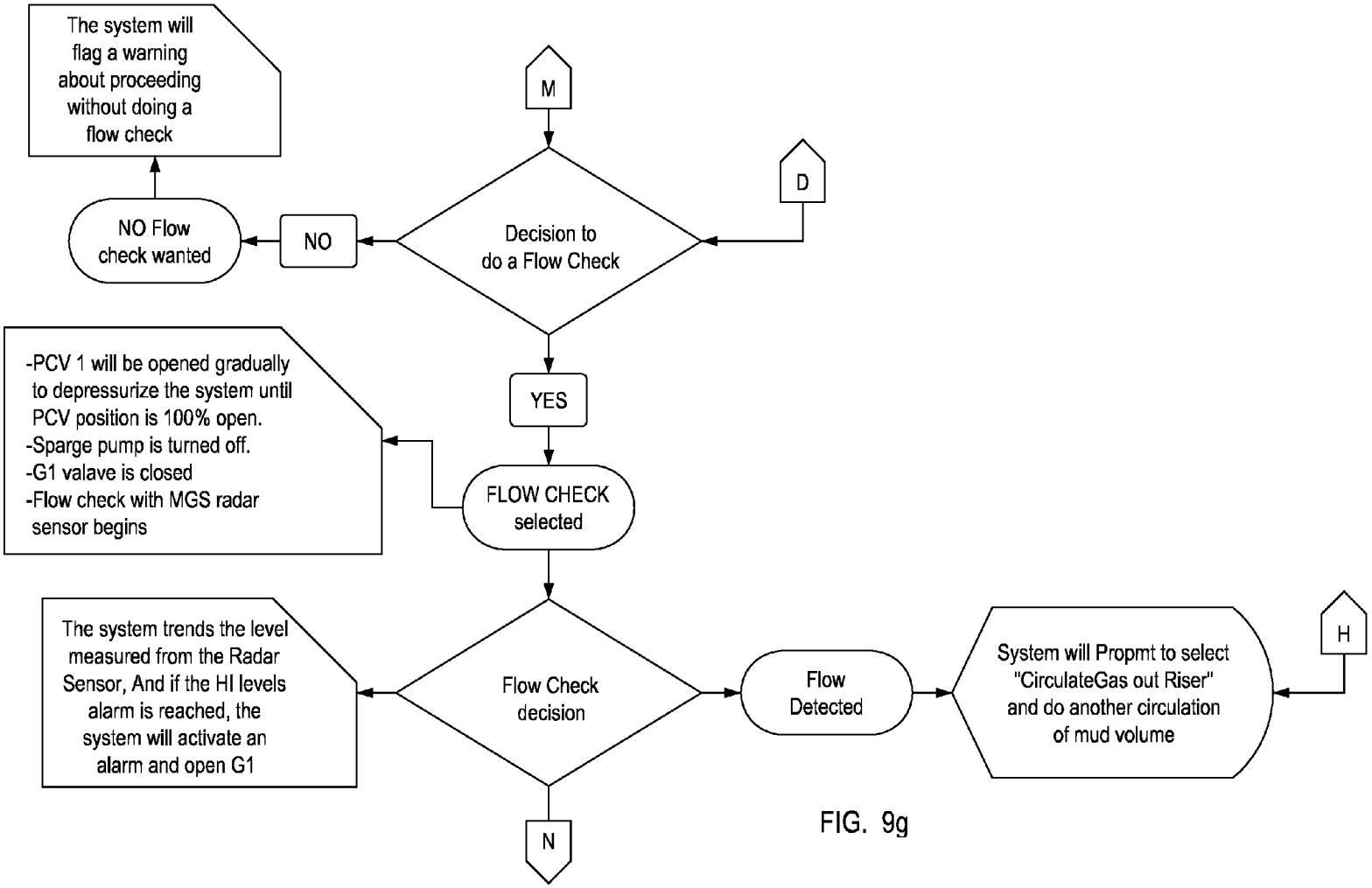
Figure 9H:
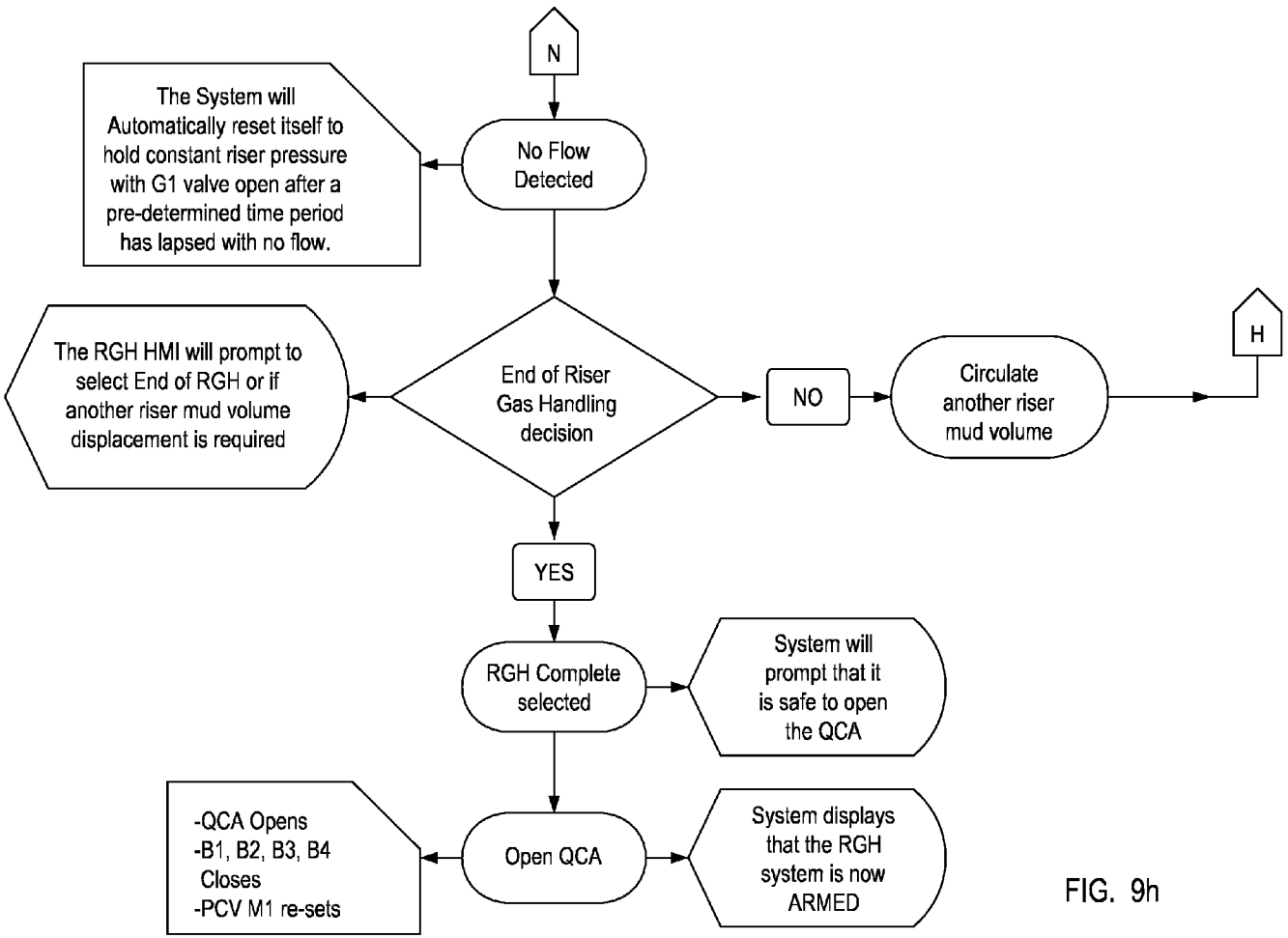

An embodiment of the invention will now be described, by way of example only, with reference to the following figures:

FIG. 1 is a schematic of a typical offshore drilling rig according to the prior art, FIG. 2 is an illustration of a diverter according to the prior art, FIG. 3 is an illustration of a riser control device according to the prior art, FIG. 4 is an illustration of the riser control device of FIG. 3 in an offshore drilling rig, FIG. 5 is an illustration of a deepwater drilling system suitable for use in accordance with the invention, FIG. 6 is an illustration of the cross-section through an annular BOP suitable for use in the drilling system shown in FIG. 5, FIG. 7 is a schematic illustration of a marine gas handling system according to invention, FIG. 8 is an illustration of a U-tube model on which the method according to the invention is based, and FIG. 9 is a flow chart illustrating the operation of the drilling system shown in FIG. 5, in accordance with the invention.

Referring now to FIG. 5, there is shown a floating drilling rig 1 for drilling a borehole through a seabed 2 beneath water surface. A blowout preventer (BOP) stack 3 is disposed on the seabed above a wellhead 4. A riser 5 and choke 6 and kill 7 are provided for well control between the floating vessel 1 and BOP stack 3. A drill string 34 extends from the drilling rig 1 through a rotary system (top drive or rotary table) along the riser 5 and into the well bore.

The riser 5 extends down from a diverter 8 located just below the floor 14 of the drilling rig 11 to the BOP stack 3, a slip joint 10 being provided in an uppermost portion of the riser 5, below the diverter 8. An annular BOP 21 and flow spool assembly 22 are also provided as part of the riser string 5, and are deployed through the rig's rotary system 23 in the same manner as the riser string 5. The flow spool 22 is located below the annular BOP 21, and comprises a portion of the riser, or tubular insert in the riser, which includes at least one port, by means of which fluid may be diverted/extracted from the riser. A pressure sensor 74, and temperature sensor 75 are provided to measure the pressure and temperature of fluid in the riser 5 between the annular BOP 21 and the flow spool 22.

The slip joint 10 has an inner barrel 9*a* which extends down from the diverter 8, and an outer barrel 9*b* which extends down to the annular BOP 21. The outer barrel 9*b* is provided with a tension ring 25 which is suspended from the drilling rig 11. Advantageously the annular BOP 21 and flow-spool assembly 22 are placed below the tension ring 25 so that the slip joint 10 configuration and heave capability remains unchanged compared with prior art arrangements. The slip joint 10 allows a riser assembly 5 to alternately lengthen and shorten as the rig 1 moves up and down (heaves) in response to wave action.

The annular BOP 21 is based on the original Shaffer annular BOP design set out in U.S. Pat. No. 2,609,836. The annular BOP 21 has a housing 29 having a central passage through which a drill string may extend. Within the housing 29 is located a piston 30 and a torus shaped packing element 31, both of which surround a drill string extending through the BOP 21. The piston 30 divides the interior of the housing 29 into two chambers—an open chamber 32 and a close chamber 26. The interior of the housing is configured such that supply of pressurised fluid to the close chamber 26 causes the piston 30 to push the packing element 31 against the interior of the housing 29, which, in turn, causes the packing element 31 to constrict and form a substantially fluid tight seal around the drill string 34.

Advantageously, the outer diameter of the annular BOP 21 is 46.5 inches, and one such configuration of annular BOP, suitable for use in this system is disclosed in our co-pending UK patent applications, GB1104885.7 and GB1204310.5, the contents of which are included herein by reference. This means that the housing of the BOP 21 is less than the inner diameter of a 49 inch rotary table 23 and diverter housing 24. The annular BOP 21 and flow-spool 22 have the same tensile capacity as the riser 5 and can support the full load of the riser 5 and subsea BOP assembly 3 beneath it.

Advantageously, the annular BOP 21 is configured to retain pressures up to 3000 psi, and uses 5000 psi accumulator bottles to close rapidly. A suitable method of operating the annular BOP 21 is described in detail in GB1204310.5. Briefly, however, in a normal closing operation, hydraulic control fluid enters the close chamber 26 from flow-spool mounted accumulator bottles 27, 28. The hydraulic fluid forces piston 30 upwardly deforming torus shaped packing element 31 into sealing contact with drill pipe 31 and closes off the bore of the annular preventer surrounding a drill pipe 31. The issue of pressure drop in conduit lines is overcome by permitting large bore conduit lines 33, 34 (2" and above) combined with multiple supply ports at the annular that supply an instantly large volumes of hydraulic fluid over short distance (15 ft) from the flow spool mounted accumulator banks 27, 28 to the annular preventer thereby minimizing pressure lost.

To assure rapid closure, two separate manifold banks of accumulator bottles 27, 28 are provided. One accumulator bank 33 bypasses the subsea regulator 35 and supplies sufficient power fluid required at a set operating pressure to close the annular BOP 21 to a stripping pressure of 500 psi via the pilot operated subsea directional control valve 36.

Fluid in opening chamber 32 above the piston 30 is expelled through multiple ports in the annular to the opening conduit line directly to atmosphere via a quick dump shuttle valve 37 instead of going back to the control fluid tank on surface. The aforementioned method provides the least resistance to the piston 30 travel to improve actuation time since it does not exert pressure loss of the opening conduit line against the operating piston 30. Advantageously, the present invention is able to seal the annulus 42 of the riser 5 around the drill string 34 within less than 3 seconds.

To regulate the closing pressure of the annular preventer, another bank of accumulator bottle 28 provides the additional hydraulic fluid required to regulate the closing pressure up to 3000 psi.

It should be appreciated that, whilst this configuration and method of operation of annular BOP 21 and associated control system is particularly advantageous, as it provides the desired quick close time, the invention is not restricted to use with this configuration and method of operation and annular BOP.

Returning now to FIG. 5, it can be seen that the drilling system includes a booster conduit 37, typically a flexible hose, that is connected to one of the riser auxiliary lines 41 on the termination joint (upper most joint with respect to seabed) with one or more mud pump 38. A flow meter 39 and a pressure sensor 40 are provided with one or more mud pumps 38 either on the mud pump 38 itself or on the booster conduit 37. The flow meter 39 can be a mud pump stroke counter, a high pressure mass balance type or preferably a clamp-on active sonar type. This riser auxiliary line is generally referred to as the booster line 41 and the pressure sensor measurement is termed the booster pressure. During drilling using deepwater rigs, it is known to pump drilling fluid down this booster conduit 37 and booster line 41 to the bottom of the riser 5 where it exits the booster line 41 and circulates up the riser string annulus 42 to increase the return velocity of the fluid column in the riser 5. This may assist in the transport of cuttings up the riser.

The flow spool 22 in this embodiment is provided with two flow outlets 45, 46 which are each connected to one of two conduits 47, 48 (in this example 6 inch flexible hose) and up to the drilling rig 1. It should be appreciated that fewer or more than two flow outlets and conduits could be used. At the drilling rig 1, the first conduit 47 is connected to a first inlet and the second conduit 48 is connected to a second inlet of a gas handling manifold 49. The flow spool 22 is also provided with four isolation valves 76, 77, 78, 79, two of which 76, 77 are operable to close the first conduit 47, and the other two of which 78, 79 are operable to close the second conduit 48.

The gas handling manifold 49 comprises two selectively adjustable restriction devices such as a pressure control valves, each of which is connected to one of the inlets. The pressure control valves 53, 54 are preferably Hemi-wedge type such as those disclosed in U.S. Pat. No. 7,357,145 B2. Preferably a tungsten carbide coating is provided on the valve core and seat for erosion protection so that the valves are capable of operating in an environment where the drilling fluid contains substantial formation cuttings. Each pressure control valve 53, 54 is coupled with an actuator and a riser gas handling controller which comprises a microprocessor which is programmed with the supervisory control and data acquisition software SCADA.

Between each inlet and associated pressure control valve 53, 54 there is, in this embodiment, a pressure sensor 72, 73 and optional flow meter 50, 51. The flow meters 50, 51 may be a high resolution mass balance type or active sonar clamp-on type flow meter.

The gas handling manifold 49 is provided with a main outlet, to which outlets of both pressure control valves 53, 54 are connected. The outlet is connected to a high flow rate diverter 55 which has an overflow pipe 57 connected to a gas cyclone separator 58, and a drain which connected to an internal cyclonic separation device 59, which is similar to the high flow rate diverter 55, provided in a mud gas separator (MGS) 56. The gas cyclone separator 58 is also connected to the MGS 56. In one embodiment, the MGS 56 is provided with a vent line 60 at its uppermost end, a series of baffle plates 61 below the internal cyclonic separation device 59, and a drain at its lowermost end. The baffle plates increase the contact area and retention time for gas breakout.

In this embodiment, the vent line 60 is 14 inches in diameter, and the drain is provided with a 12 inch internal diameter, 20 foot high liquid seal, there being a pressure sensor 65, and a liquid seal isolation valve 110 between the liquid seal and the MGS 56. Also in this embodiment, the MGS 56 is 2 m wide and 9 m high, The MGS 56 thus has the capacity to handle a large gas influx, for example an influx which is in excess of 10 bbls, whilst still maintaining sufficient hydrostatic pressure to prevent gas blow-by even when the pressure control valves 53, 54 fail wide open.

In this embodiment, the MGS 56 is provided with a level sensor 63, of radar, ultrasonic or proximity switch type, for measurement of the fluid level in the MGS vessel, along with a further pressure sensor 64, and a densitometer D which is located at the lowermost end of the MGS vessel. In this embodiment, a high rate centrifugal pump 68 is connected to the MGS 56, and is operable by a controller to pump fresh mud from the mud tanks 62 into the MGS 56. The level sensor 63 provides an input for the pump controller, the controller being programmed to turn off the pump 68 when the level sensor 63 determines that the liquid level in the MGS 65 exceeds a predetermined level. Preferably the pump 68 is operable to pump up to a rate of 500 gpm.

A 3-way valve non closing valve 66 is installed at the end of the liquid seal 110, this valve being operable to direct fluid from the liquid seal 110 to either the mud tanks via the rig's solids control equipment 71 (such as a shaker table) or overboard.

It is advantageous to provide overpressure protection of the riser string and the surface equipment. Therefore, in one embodiment, the system is fitted with six levels of over protection. There are four Safety Integrity Level three (SIL3) rated pressure relief valves, two 105, 106 which are provided in a discharge conduit 112, which extends from the flow spool 22, and the other two 107, 108 on the gas handling manifold 49. The two pressure control valves 53, 54 on the gas handling manifold 49 may also dual function as relief valves.

The main pressure control valve 53 will be set to relief at 500 psi while the back up pressure control valve 54 will be set to relief at 700 psi. During influx circulation, however, it is expected that surface pressures may exceed 700 psi; hence the backup pressure control valve 54 will be designated as a backup pressure control valve instead of a relief valve. In any case, the system will still be adequately protected by pressure relief valves 105, 106, 107, 108.

The main flow spool pressure relief valve 105 is a mechanically set pressure relief valve. It is sized for the maximum surge liquid flow rates that may be encountered during riser gas handling and set at 85% of the maximum allowable riser working pressure. The backup flow spool pressure relief valve 106 is sized for the same relief condition but set at 100% of the maximum allowable riser working pressure. The backup flow spool pressure relief valve 106 is a programmable relief valve with a manual override to allow for back flushing of the discharge conduit 112 which is connected to a three way valve 113 just above water level 2*a*, for discharge overboard.

The pressure relief valve 107 on the gas handling manifold 49 discharges to a three way valve 109 to go overboard, and is also designated to protect the riser 5. Similarly, it is sized for maximum surge liquid flow rates that may be encountered during riser gas handling, but set at 75% of the maximum allowable riser working pressure. The programmable relief valve 107 is purposely set lower than the flow spool relief valves since it is more accessible for maintenance as compared to the flow spool valves that are deployed subsea. Additionally, the valve will also discharge return flow overboard, should level in the MGS 56 reach the "HI HI" limit due to failure of the liquid seal isolation valve 110 in the close position.

The other pressure relief valve on the gas handling manifold 108 discharges back to the mud gas separator 56, and is designed to protect the casing shoe 111 and sized for blocked discharge. It is set to relieve pressure at the dynamic maximum allowable surface pressure.

This drilling system is illustrated schematically in FIG. 7, and may be operated as described below, and as illustrated in FIG. 9.

It will be appreciated that while drilling with oil based mud, gas from formation penetrated by the well bore can go into solution in the mud and not reach its bubble point until it just below the rotary system 23. If no action is taken to prevent this, there can be a violent unloading of gas in the riser 5 endangering personnel on the rig floor. As such, conventional procedures and methods (such as first picking up the drill string, then turning off the pumps, followed by shutting in the Subsea BOP and then flow checking the well over a trip tank) are used to determine if there may have been an influx of gas into the riser. The operator then determines whether this is an emergency or a precautionary situation. In an emergency situation, a violent unloading of the riser has already occurred on the drill floor and this requires immediate activation of the annular BOP 21 with the mud pumps still running. For precautionary situation, the mud pumps are turned off and at least one of the BOPs in the subsea BOP stack 3 closed, before the annular BOP 21 is closed as a precautionary measure.

For an emergency situation, the procedure is as follows.

The drill string 34 is lifted off the bottom of the well bore and the rotary system 23 (top drive or rotary table) switched off. The riser gas handling system is then activated, and the annular BOP 21 operated to fully seal around the drill string 34 as described above (preferably within 3 secs of the system being activated). After the annular BOP 21 is closed, the flow spool isolation valves 76, 77, 78, 79 are opened to allow flow along the two conduits 47, 48 to the gas handling manifold 49. The riser gas handling controller is preferably programmed ensure that that the isolation valves 76, 77, 78, 79 open only after the annular BOP 21 is closed. These steps may be carried out while the mud pumps 38 are still running, so that the influx volume is minimised and the gas present in the riser compressed as much as possible. The system should not be damaged by leaving the mud pumps on as the annular BOP 21 closes because, when the riser gas handling system is activated, the pressure control valves 53, 54 on the gas handling manifold 49 are set to automatically maintain 500 psi and 700 psi back pressure on the riser 5, respectively, and will bleed drilling fluid should pressures in the riser annulus 42 increase above the set points.

Once the annular BOP 21 is closed, the mud pumps 38 are shut down, and conventional well control procedures are carried out to shut in the well with the BOP stack 3.

For the precautionary situation, the BOP stack is closed in when an influx is detected, the booster pump is stopped. The riser is then closed in with the annular BOP, monitoring the riser pressure through the pressure sensors 72 73.

The decision is then made by an operator as to whether to kill the well or just to circulate the gas out of the riser.

If gas continues to migrate up the riser but is not attended to, it is expected that the pressure could rise above 500 psi. In this case the pressure control valve 53 will bleed off the excess pressure to maintain 500 psi on the system. If the pressure rises over 500 psi, then the back up pressure control valve 54 will open to maintain surface back pressure in the riser at 700 psi.

If it is decided that circulation of the gas influx out of the riser is sufficient, and it is not necessary to kill the well, the control system for the annular BOP 21 is operated to increase the fluid pressure in the close chamber 26 so that the annular BOP 21 is operating at its maximum (in this example 3,000 psi) working pressure. The riser booster mud pump 38 is then started to pump mud down the booster conduit 37 to the bottom of the riser 5 just above the uppermost BOP in the BOP stack 3. The pump rate is slowly increased to a predetermined riser kill rate, whilst maintaining a substantially constant 500 psi back pressure on the riser annulus 42. The 500 psi can be regarded as a safety factor, and is automatically maintained by regulating the pressure control valve 53 in the riser gas handling manifold 49 during the pump rate change.

Once the pump is at kill rate (or at least within +/−10% of the kill rate), the riser gas handling controller will verify that the actual initial booster circulation pressure reading is similar (within 10%, for example) to the pre-recorded booster circulation pressure. If this is the case, the system will proceed to circulate out the influx automatically holding the initial booster pressure, and swapping over the control mode to hold the pressure in the booster line 37 constant, as will be discussed further below. If it is not the case, the system will prompt the operator to evaluate. An operator may then, if necessary, turn off the pump in order to discover the cause of the discrepancy, before restarting the circulation process, once this issue is resolved.

As mud is pumped into the riser 5, the gas and mud mixture in the riser 5 is diverted through the two flow outlets 45, 46 on the flow spool 22 and through the two conduits 47, 48 up to the water surface. The gas and mud mixture then enters the gas handling manifold 49.

When the mud and gas mixture exits the gas handling manifold 49, it enters the high flow rate diverter 55 tangentially into its housing, creating powerful centrifugal forces whereby the heavier mud and cuttings spiral down the wall to the outlet at the bottom and discharges into the MGS 56. The higher flow rate diverter 55 should be able to remove 70% of the entrained gas in the drilling fluid. The lighter gas coalesces and moves towards the axis of the diverter 55 and leaves via the overflow pipe 57 to the cyclone gas separator 58 where entrained mud is further removed from the gas through similar centrifugal action. Both gas and liquid outlet legs are discharged into the MGS 56.

The drilling fluid returns enter the mud gas separator 56 vessel through a 10" inlet line to the internal cyclonic inlet separation device 59. The vessel of the mud gas separator 56 is designed to be as large as possible (in one embodiment 2 m in diameter and 9 m in height). The lower density gas flows towards the upper section of the vessel and is discharged to atmosphere at the top of the drilling rig 1, as a safe distance from personnel and equipment on the rig 1, using the dedicated 14" vent line 60.

The denser mud and cuttings flows towards the bottom of the MGS 56, through the baffle plates 61 which are set at an angle to ensure high drainage and minimize risk of solids build up. As the fluid makes it way down the MGS 56, it changes direction several time thereby increasing the separation contact area and retention time for further entrained gas to break out. The mud and cutting returns flow through the liquid seal before going back to rig's solids control equipment such as a shaker table for further processing before returning to the mud tanks 62.

The liquid level in the mud gas separator is controlled by the hydrostatic column of mud in the liquid seal. Calculations have shown that an intermittent peak gas rating of 80 mmscfd and 4600 gpm surge liquid can be achieved with 12.28 psi retention in a 6*m* liquid seal full of 12 ppg mud.

Based on the pressure differential between the separator vessel pressure (determined using the output of pressure sensor 64) and liquid leg pressure (determined using the output of pressure sensor 65), the operator will be able to determine if the liquid seal is lost. For example, a significant increase in vessel pressure coupled with a low level reading may indicate loss of liquid seal.

In the event that the liquid seal is lost due to a gas blow-by event, the drilling fluid may be routed overboard using the three-way valve 66 installed at the end of the liquid seal. Ordinarily, however, it is directed back to the solid control equipment which is designed to remove contaminates from the mud which includes cuttings from the fluid, before being returned to the mud reservoir which is in communication with the mud pump 38.

It is known that a reduction of liquid seal hydrostatic pressure can occur in the MGS 56 as a result of gas bubbling through liquids and splashing on solid surfaces such as baffle plates. Emulsification may also reduce the liquid seal's hydrostatic pressure when formation fluid such as oil and water mixes with the drilling fluid. To mitigate these issues and ensure the integrity of the liquid seal, the high rate centrifugal pump 67 capable of 500 gpm may be operated to introduce fresh drilling mud from the mud tanks 62 to assure a constant level of the liquid seal at all times. The level sensor 63 will be interconnected with the controller of the high rate pump 68 and configure to automatically turn off the pump when a high level alarm is reached, and resume when the alarm has cleared. The densitometer 69 may also be used to measure mud density in the vessel to sense gas cut, foaming or emulsification problems of the mud. The introduction of hot mud by the pump may mitigate the formation of hydrates in the vessel, and glycol injection points maybe provided in the gas handling manifold 49 as required.

The gas and mud mixture flows through the flow meters 50, 51 in the gas handling manifold, and using the output from these flow meters 50, 51, and the output from the flow meter 39 in the booster conduit 37, an operator may determine the difference between the flow rate into the riser 5 and the flow rate out of the riser 5.

This technique for handling gas in the riser is based on the U-tube model illustrated in FIG. 8. Once the BOP stack 3 is closed, the drill pipe 31, which extends below the BOP stack 3 can no longer be used to circulate out the gas in the riser 5. However, any of the auxiliary riser lines which include the riser booster 41, choke 6 and kill lines 7 may be used to circulate mud up the riser annulus 42. In this embodiment of the invention, the booster conduit 37 and booster line 41 are used. As illustrated in FIG. 8, the left side of the U-tube is the riser booster line 41 while the right side represents the riser annulus 42. Therefore, the U-tube illustrates the booster line 41 entering the bottom of the riser 5, an influx of formation fluid 70 having entered the annulus of the riser above the shut in BOP stack 3. The riser 5 has been shut in by the annular BOP 21, which means the system is closed. Under the shut in conditions there is a static pressure on the booster line 41, which is denoted by $P_{bl}$, and static pressure on the riser annulus 42, which is denoted by Pa. The gas influx 70, has entered the annulus and occupies a volume defined by the area of the annulus and height of the influx 70. Under static conditions, the bottom riser pressure can be easily determined from the booster line side since it is the homogeneous side of known mud density.

$$P_r = P_{bl} + p_m D$$

Where:

$P_r$=Bottom riser pressure $P_{bl}$=booster line pressure $P_m$=Mud density in booster line $D_r$=Depth of the riser Those skilled in the art will appreciate that as a large gas influx (>50 bbls) expands, both the pressure at the bottom of the riser $P_r$ and the booster line pressure $P_{bl}$, would decrease due to loss of mud hydrostatic in the annulus. However, the flowing annulus pressure of the well will increase since gas expansion pushes the mud out of the riser 5 at surge rate that far is greater than the booster pump rate in.

The flow rate out will surge in proportion to the gas expansion ratio of the gas in the riser 5, and so the flow rate may be several times higher than the flow rate in. The gas and mud mixture flows through the flow meters 50, 51 in the gas handling manifold, and using the output from these flow meters 50, 51, and the output from the flow meter 39 in the booster conduit 37, an operator may determine the difference between the flow rate into the riser 5 and the flow rate out of the riser 5.

To mitigate the uncontrolled gas expansion described above, the system is operated to maintain a substantially constant circulating booster line pressure during influx circulation which is the summation of the shut in booster line pressure plus the pump pressure at the designated pump rate and may include an added pressure safety margin. Surface back-pressure is constantly applied by the pressure control valves 53, 54 to maintain a constant circulating booster pressure and to achieve the desired control of the gas expansion as it is being circulated up the riser 5.

To reduce the amount of human intervention, calculation and time required to execute this method, a supervisory control and data acquisition system SCADA is used to automate the riser gas handling system. As such, the riser gas handling controller includes programmable logic controllers which are electronically interconnected with the sensors shown in FIG. 5, including, but not limited to, flow meters 39, 50 and 51, pressure sensors 40, 64, 65, 72, 73, and 74, level sensor 63, and temperature sensor 75. Parameters which may be sensed and inputted to the controller may include flow in and flow out, temperature out, booster pump pressure, flow spool pressure, surface back pressure, mud gas separator pressure and valve positioners. The riser gas handling controller will utilize the signals provided by the sensors to automatically manipulate the valves on the system. Valves to be manipulated may include the isolation valves 76, 77, 78, 79, and pressure relief valves 105, 106 on the flow spool 22, the valves controlling operation of the annular BOP 21, the back pressure control valves 53 54 on the gas handling manifold 49, the isolation valve 107, and three way valve 66 on the MGS liquid leg.

Redundant sensors at each respective sensed location will be installed, such that each sensing act is performed by two or more sensors so that the values can be compared and accuracy determined based on a voting logic or other statistical control techniques. Such sensor configurations and techniques may increase the reliability of information utilized in controlling a gas influx situation during a riser kill operation.

The control system may be programmed to routinely record riser booster circulating rates and pressures after each drilling fluid weight change or after pump repairs, for example. At the designated kill rate, a corresponding booster line circulating pressure may be sensed and recorded by the programmable logic controller. The circulating pressures recorded will be used as a confirming reference to the actual circulating pressures determined during the riser kill.

In one embodiment of the invention the control system monitors the rate of pumping of fluid into the booster line 37, and, if this rate of pumping deviates from a predetermined value or range of values (for example because of pump failure or malfunction), uses pressure sensor 74 in the riser 5 to measure the fluid pressure in the riser annulus, and operates the pressure control valves 53, 54 to maintain the pressure in the riser annulus at a substantially constant pressure, rather than the pressure in the booster line 37. In this case, the control system is preferably programmed to return to operating the pressure control valves 53, 54 to maintain the pressure in the booster line 37 at a substantially constant pressure if the pumping rate returns to the predetermined value or range of values.

If it is decided to kill the well, kill mud is circulated in the BOP stack 3 in accordance with standard well killing procedures. When well control is complete the system then operates to circulate the gas influx out of the riser 5 just as described above.

After displacing the influx or completing the required displacement volume of the riser 5, the riser 5 can be shut in, again holding 500 psi constant with the pressure control valves 53, 54 while slowing down the pumps. The riser gas handling controller will sense that the pump rate is no longer at predetermined kill rate and automatically revert back to holding 500 psi back pressure on the annulus whilst the pumps are turned off. It should be noted both shut in back pressure and booster line pressure should read the same 500 psi if the influx has been completely displaced.

The riser gas handling controller may then prompt the operator to carry out a riser flow check. If the operator elects to carry out a riser flow check, the pressure in the riser 5 is monitored, and if it continues to rise, the system will bleed off the pressure in a controlled manner to maintain 500 psi. This indicates the influx is not completely displaced, and circulation at kill rate can be reestablished.

If pressure does not build up in the riser, the system can be directed to execute a known flow check routine to check if the riser is still flowing. The riser gas handling controller will sequentially stop the centrifugal pump 68, open up the backpressure control valve 53, 54 slowly to depressurize the system until both pressures are zero, and close the isolation valve 110 on the liquid leg of the MGS 56. The riser gas handling controller will monitor the mud volume in the MGS vessel as a function of time, using the level sensor 63 to perform a totalizing function. If the HI levels alarm is reached, the system will activate an alarm and open the isolation valve 110.

If the well is flowing, the riser gas handling controller may shut the pressure control valves 53, 54 and prompt the operator to continue to circulate mud from the riser 5.

If no flow is observed, the riser can be circulated over to kill mud if kill mud weight is known. If kill mud is not known or not required, the operator can reopen the subsea BOP stack 3 to flow check the well. If the flow check indicates that the well is static, then the system can be prompted to proceed with the "armed" function. Upon receiving such command, the system will sequentially open the annular BOP 21, close the flow spool isolation valves 76, 77, 78, 79 and close the pressure control valves 53 54. Drilling may then be resumed.

It will be appreciated that, whilst in the drilling system described above, the booster conduit 37 and line 41 are used to displace the gas influx in the riser 5 whilst maintaining a constant booster pressure to control gas expansion, the other riser auxiliary lines such as the choke line 6 or the kill line 7 could be used instead. This configuration is not preferred, however, since it requires the lowest ram blowout preventer 16 to be closed and the subsea annular preventers 43, 44 in the BOP stack 3 left open during influx circulation so that the choke and kill lines can provide hydraulic access to the riser 5.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of operating a system for handling an influx of gas into a marine riser during the drilling of a well bore, the method including the steps of:

operating a first riser closure apparatus to close the riser at a first point above a flow spool provided in the riser, there being a riser gas handling line extending from the riser at the flow spool to a riser gas handling manifold;

operating a second riser closure apparatus to close the riser at a second point below the flow spool so as to form a volume in the riser between the first riser closure apparatus and the second riser closure apparatus, and to shut-in the well bore so that a flow of fluid from the well bore below the second riser closure apparatus into the volume between the first riser closure apparatus and the second riser closure apparatus does not occur;

pumping fluid into an inlet line that extends into the riser at a point above the second point but below the flow spool; and operating a choke provided in the riser gas handling manifold to maintain the pressure in the inlet line or the riser at a substantially constant pressure, wherein, the pumping of the fluid into the inlet line that extends into the riser at the point above the second point but below the flow spool, and the operating of the choke provided in the riser gas handling manifold to maintain the pressure in the inlet line or the riser at the substantially constant pressure are each performed when the first riser closure apparatus has closed the riser at the first point above the flow spool, and the second riser closure apparatus has closed the riser at the second point below the flow spool to shut-in the well bore so that a flow of fluid from the well bore below the second riser closure apparatus into the volume between the first riser closure apparatus and the second riser closure apparatus does not occur.

2. The method according to claim 1, wherein the first riser closure apparatus is an annular blow out preventer.

3. The method according to claim 1, wherein the step of operating the first riser closure apparatus further comprises the step of operating the first riser closure apparatus so that the first riser closure apparatus seals around a drill string extending down the riser.

4. The method according to claim 1, wherein the second riser closure apparatus is a blow out preventer in a subsea blowout preventer stack.

5. The method according to claim 1, wherein the step of operating the second riser closure further apparatus comprises the step of operating the second riser closure device so that the second riser closure device seals around a drill string extending down the riser.

6. The method according to claim 1, wherein the first point is below a slip joint provided in the riser.

7. The method according to claim 1, wherein the second point is just above a well head.

8. The method according to claim 1, wherein the riser gas handling manifold is located on a drilling rig from which the riser is suspended.

9. The method according to claim 1, wherein the inlet line comprises a booster line that extends from a pump located on a drilling rig from which the riser is suspended, to a portion of the riser just above the uppermost blowout preventer in a subsea blowout preventer stack at the lowermost end of the riser.

10. The method according to claim 1, further including the step of opening a riser gas handling line isolation valve that is operable to permit or substantially prevent flow of fluid along the riser gas handling line after operating the first riser closure apparatus.

11. The method according to claim 10, wherein the step of opening the riser gas handling line isolation valve is carried out before operating the second riser closure apparatus.

12. The method according to claim 1, further including the step of ceasing the pumping of fluid into the riser prior to the step of operating the second riser closure apparatus.

13. The method according to claim 12, wherein the step of ceasing the pumping of fluid into the riser is carried out after the step of operating the first riser closure apparatus.

14. The method according claim 1, wherein the rate of pumping of fluid into the riser via the inlet line is increased to a predetermined level, and, at the same time, the choke is operated to maintain a substantially constant pressure in the riser.

15. The method according to claim 14, wherein the step of operating the choke to maintain a substantially constant pressure in the inlet line is commenced once the rate of pumping of fluid into the riser via the inlet line has reached the predetermined value.

16. The method according to claim 1, wherein there is a second riser gas handling line extending from the riser at the flow spool to the riser gas handling manifold.

17. The method according to claim 16, further including the step of opening a second riser gas handling line isolation valve that is operable to permit or substantially prevent flow of fluid along the second riser gas handling line after operating the first riser closure apparatus.

18. The method according to claim 1, wherein the step of operating the choke provided in the riser gas handling manifold to maintain the pressure in the inlet line at a substantially constant pressure further comprises the steps of using a pressure sensor to measure the fluid pressure in the inlet line, and transmitting an inlet pressure signal representative of the fluid pressure in the inlet line to a controller, the controller being programmed to operate the choke in accordance with the inlet pressure signal.

19. The method according to claim 1, further including the steps of monitoring the rate of pumping of fluid into the inlet line, and, if this rate of pumping deviates from a predetermined value or range of values, using a pressure sensor to measure the fluid pressure in the riser, and operating the choke to maintain the pressure in the riser at a substantially constant pressure.

20. The method according to claim 19, further including the steps of returning to operating the choke to maintain the pressure in the inlet line at a substantially constant pressure if the pumping rate returns to the predetermined value or range of values.

21. The method according to claim 1, further including the step of directing fluid discharged from the riser gas handling manifold to a mud gas separator located on the floor of a drilling rig from which the riser is suspended.

22. The method according to claim 21, wherein the fluid discharged from the riser gas handling manifold is directed to a diverter before being directed to the mud gas separator, the diverter acting to separate a proportion of entrained gas from the remainder of the fluid.

23. The method according to claim 22, wherein all the fluid from the diverter is directed to the mud gas separator.

24. The method according to claim 23, wherein the mud gas separator is provided with baffle plates in a lowermost end thereof.

25. The method according to claim 21, further comprising the step of directing the denser fluids from the mud gas separator to a solids processing apparatus.

26. The method according to claim 21, further comprising the step of directing the lighter fluid from the mud gas separator to a vent line that exhausts to atmosphere.

27. The method according to claim 21, wherein the mud gas separator is provided with a drain at a lowermost end thereof, the drain having a liquid seal to retain pressure in the mud gas separator.

28. The method according to claim 21, further comprising the step of pumping extra fluid into the mud gas separator, in addition to the fluid entering from the riser gas handling manifold.

* * * * *